US005875370A

United States Patent [19]

Patton et al.

[11] Patent Number: 5,875,370

[45] Date of Patent: Feb. 23, 1999

[54] COATING APPARATUS HAVING A REMOVABLE COATING MODULE FOR APPLYING A PROTECTIVE COATING TO PHOTOSENSITIVE MATERIAL

[75] Inventors: David L. Patton; Kevin M. O'Connor, both of Webster; Anne E. Bohan, Pittsford; Ralph L. Piccinino, Jr., Rush, all of N.Y.

[73] Assignee: Eastman Kodak Company, Rochester, N.Y.

[21] Appl. No.: 965,105

[22] Filed: Nov. 6, 1997

[51] Int. Cl.[6] ..... G03D 5/00

[52] U.S. Cl. ..... 396/606; 396/608; 118/670; 118/118; 427/355

[58] Field of Search ..... 396/604, 606, 396/608, 609, 626, 636, 641; 118/116–118, 110, 223, 263, 264, 676, 677, 670, 679; 427/355

[56] References Cited

U.S. PATENT DOCUMENTS

| | | | |
|---|---|---|---|
| 2,173,480 | 9/1939 | Jung | 352/56 |
| 2,751,315 | 6/1956 | Staehle | 430/401 |
| 3,083,120 | 3/1963 | Paterson | 427/433 |
| 3,453,138 | 7/1969 | Chen et al. | 396/606 |
| 4,456,637 | 6/1984 | Takeda et al. | 427/355 |
| 4,464,035 | 8/1984 | Schoering | 396/577 |
| 4,623,236 | 11/1986 | Stella | 396/606 |
| 4,722,297 | 2/1988 | Keable | 118/670 |
| 4,737,810 | 4/1988 | Kobayashi et al. | 396/575 |
| 4,967,221 | 10/1990 | De Prijcker et al. | 396/606 |
| 5,279,861 | 1/1994 | Shigeta | 427/402 |
| 5,309,192 | 5/1994 | Lu | 396/606 |
| 5,481,328 | 1/1996 | Verhoest et al. | 396/626 |
| 5,694,991 | 12/1997 | Harris et al. | 141/346 |

*Primary Examiner*—D. Rutledge
*Attorney, Agent, or Firm*—David A. Novais

[57] ABSTRACT

The present invention relates to a coating apparatus having a removable coating module for applying a protective coating to at least one surface of a photosensitive material. The coating apparatus can be a stand-alone unit and can be added to an existing or new photographic processor. The coating product can be a solution having a predetermined viscosity which is applied to at least one surface of the photosensitive material prior to drying in a manner that allows the solution to be uniformly applied to the at least one surface at a specific layer thickness. The viscous solution after drying functions as a protective coating which can protect the processed photosensitive material against scratches and moisture. The removable coating module facilitates maintenance and cleaning after the viscous solution has been consumed. The apparatus includes a control mechanism which controls the thickness, uniformity and laydown amount of the applied viscous solution so as to insure that a uniform coating that provides protection to the entire surface of the photosensitive material is provided.

42 Claims, 18 Drawing Sheets

FIG. 5
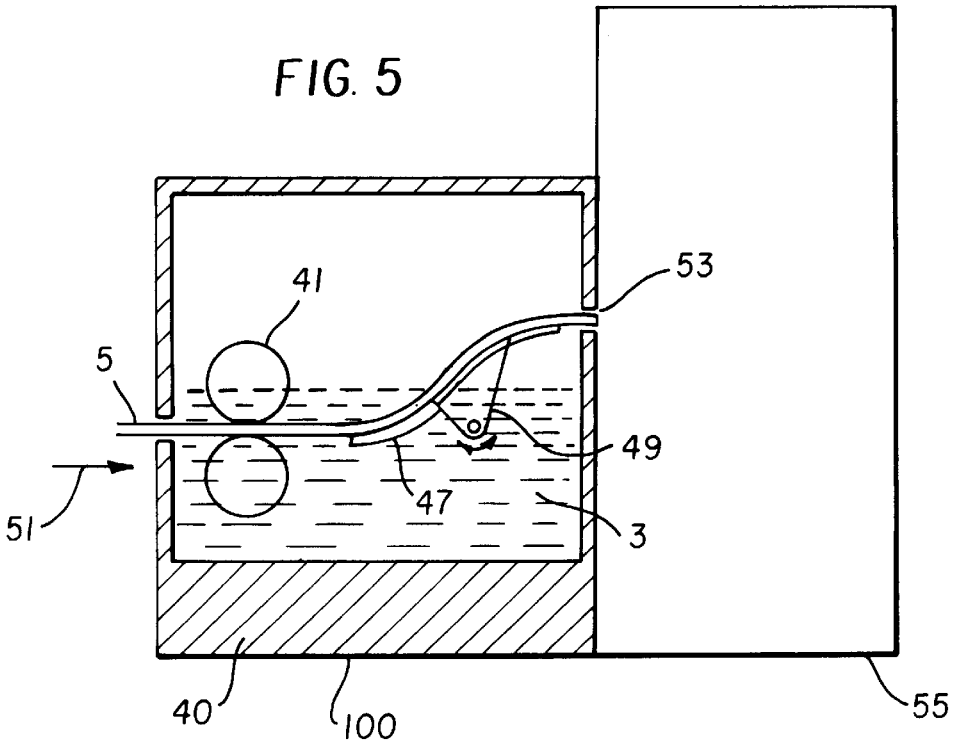
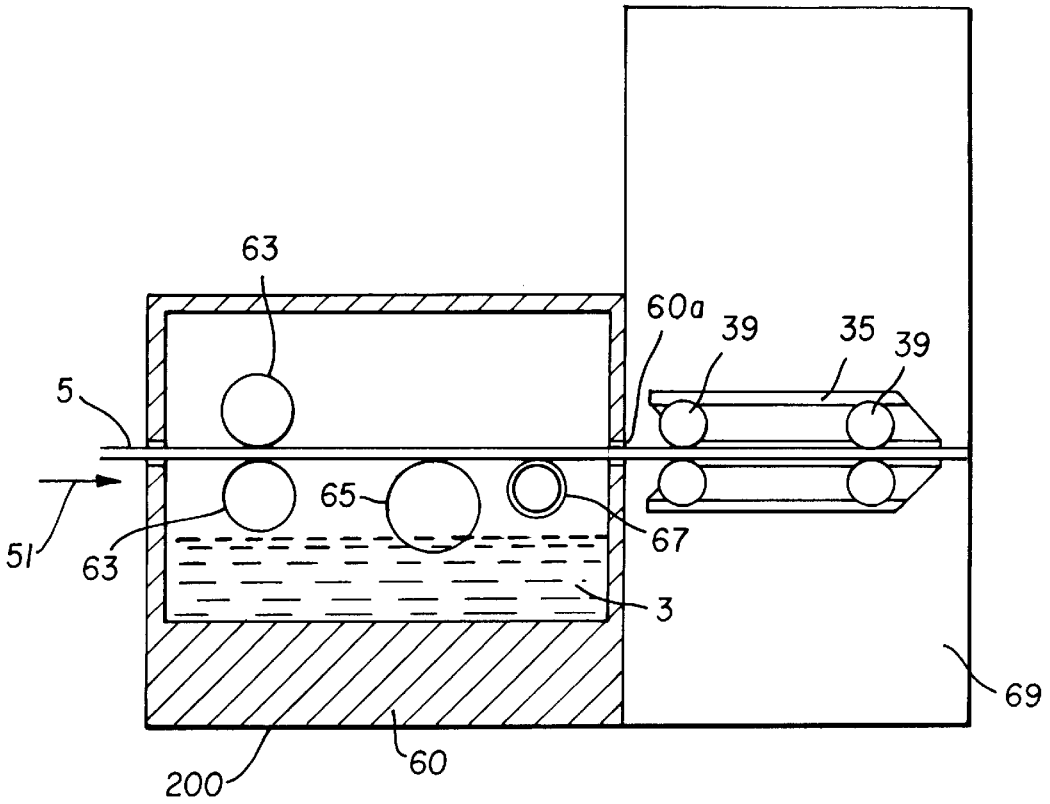
FIG. 6

COATING APPARATUS HAVING A REMOVABLE COATING MODULE FOR APPLYING A PROTECTIVE COATING TO PHOTOSENSITIVE MATERIAL

CROSS REFERENCE TO RELATED APPLICATIONS

This application is related to the following applications filed concurrently herewith:

U.S. Ser. No. 08/965,560 entitled A METHOD AND APPARATUS OF APPLYING A SOLUTION OF A PRE-DETERMINED VISCOSITY TO PHOTOSENSITIVE MATERIAL TO FORM A PROTECTIVE COATING THEREON of David Lynn Patton, Anne E. Bohan, Kevin M. O'Connor, Ralph F. Piccinino, Jr., Gordon F. Breese and Ramasubraman Hanumanthu.

U.S. Ser. No. 08/965,639 entitled A REPLACEABLE CARTRIDGE COATING ASSEMBLY AND METHOD OF COATING A PHOTOSENSITIVE MATERIAL USING THE SAME of David Lynn Patton, Anne E. Bohan, Kevin M. O'Connor and Ralph F. Piccinino, Jr.

FIELD OF THE INVENTION

The present invention relates to the photoprocessing field. More particularly, the present invention relates to a coating apparatus having a removable coating module for applying a protective coating on at least one surface of a photosensitive material.

BACKGROUND OF THE INVENTION

When photosensitive material is processed in a processing tank using current photographic processors, squeegees are used to remove as much of the processing surface liquid as possible to avoid contamination at the next processing tank. In some cases, no effort is made to remove the processing surface liquid.

It is not common to apply a protective coating on a photosensitive material in a bath, however, in cases where a protective coating is applied, the protective coating is usually in the form of a coating solution. The coating solution when consumed will leave a residue in the tank and on the elements and mechanisms within the tank, which is difficult to clean and adversely affects maintenance and production. Furthermore, these coating solutions tend to dry and solidify when exposed to air or when the coating apparatus is not running, such as during off-hours or a non-working cycle which also makes cleaning difficult.

Also, in cases where a protective coating is applied to a photosensitive material, there is little attempt to control the specific laydown of the coating on the surface on the photographic material. This is due to the fact that currently in order to apply a solution to the surface of a web in uniform layer amounts, it is necessary that it be done in manufacturing under very controlled conditions and temperature. This is difficult to do in a minilab or a traditional lab photographic processing environment as an integral part of the process.

In order to apply a protective coating to an emulsion surface of a photosensitive material, control over the thickness, uniformity and laydown amount of the layer being applied is needed in order to provide for adequate protection against moisture and scratches. The control is needed for several reasons: (1) the protective coating must be applied in a manner that insures that the surface is uniformly coated so that the coating can provide adequate protection to the entire surface; (2) the thickness of the coating must be controlled because if the coating is too thick, it could cause cracking due a non-uniform drying; (3) a thick coating could dull the surface and the underlying image; and (4) the coating solutions can be of different viscosities. Conventional methods of immersing the photosensitive materials into a bath and squeegeeing off the excess liquid will not provide for a uniform protective coating and may produce too thin a coating which would provide inadequate protection.

SUMMARY OF THE INVENTION

The present invention provides for a novel coating apparatus having a removable coating module for applying a protective coating to photosensitive material. The coating apparatus can be a stand-alone coating apparatus that is adaptable to new or existing processors.

The arrangement of the present invention facilitates the maintenance and cleaning of the coating apparatus by providing for a coating module which is easily removable and insertable into the coating apparatus, and at the same time, the coating module facilitates the uniform application of a solution of predetermined viscosity to processed photosensitive materials prior to drying. The viscous solution, when dry, will act as a protective coating to protect both against scratches and damage due to spills.

With the apparatus of the present invention it is possible to remove the coating module at the end of a working cycle. This permits the user to rinse out the interior of the coating module and place it back into the apparatus or processor for the next working cycle.

The present invention provides for a coating apparatus for use in a processor for processing photosensitive material. The coating apparatus includes a body and a removable coating module removably positioned within the body. The removable coating module has an inlet and an outlet through which the photosensitive material passes. The removable coating module further includes a housing assembly which is adapted to a hold solution of a predetermined viscosity therein, with the housing assembly comprising an applicator which applies a layer of the viscous solution on at least one surface of the photosensitive material as the photosensitive material passes through the removable coating module, and a controller which controls a thickness, uniformity and laydown amount of the viscous solution applied to the at least one surface of the photosensitive material.

The present invention also relates to a processor for developing photosensitive material, with the processor comprising a processing section for developing a photosensitive material, the processing section comprising at least one processing tank containing a processing solution therein; and a coating section disposed downstream of the processing section with respect to a direction of travel of the material. The coating section includes a body and a removable coating module removably positioned in the body. The removable coating module is adapted to hold a solution of a predetermined viscosity therein and comprises an inlet and an outlet through which the material passes; an applicator mounted in the coating module which applies a layer of the viscous solution to at least one surface of the material as the material passes through the coating module; and a controller which controls a thickness, uniformity and laydown amount of the viscous solution applied to the at least one surface of the material.

The present invention also relates to a coating apparatus for use in a processor for developing photosensitive material. The coating apparatus comprises a removable coating module removably positioned in a tank of a processor. The coating module has an inlet and an outlet through which a photosensitive material passes. The coating module is adapted to hold a solution of a predetermined viscosity therein, such that a photosensitive material which passes through the coating module is coated with the viscous solution. The coating apparatus further includes a controller mounted in the coating module which controls a thickness, uniformity and laydown amount of the applied viscous solution.

The present invention also relates to a coating apparatus for use in a processor for processing photosensitive material which provides a protective coating on the photosensitive material. The coating apparatus includes a body and a removable coating module positioned within the body. The removable coating module has an inlet and an outlet through which the photosensitive material passes and is adapted to hold a product therein which forms a protective coating on at least one surface of the photosensitive material. The removable coating module comprises an applicator which applies the protective coating on the at least one surface of the photosensitive material as the photosensitive material passes through the removable coating module, and a controller which controls the application of the protective coating on the at least one surface of the photosensitive material so as to provide for a protective coating having a predetermined characteristic.

BRIEF DESCRIPTION OF THE DRAWINGS

FIG. 5 is a variation of the apparatus of FIG. 1;

FIG. 6 is a schematic drawing of the apparatus of the present invention;

DETAILED DESCRIPTION OF THE INVENTION

Figure 1:
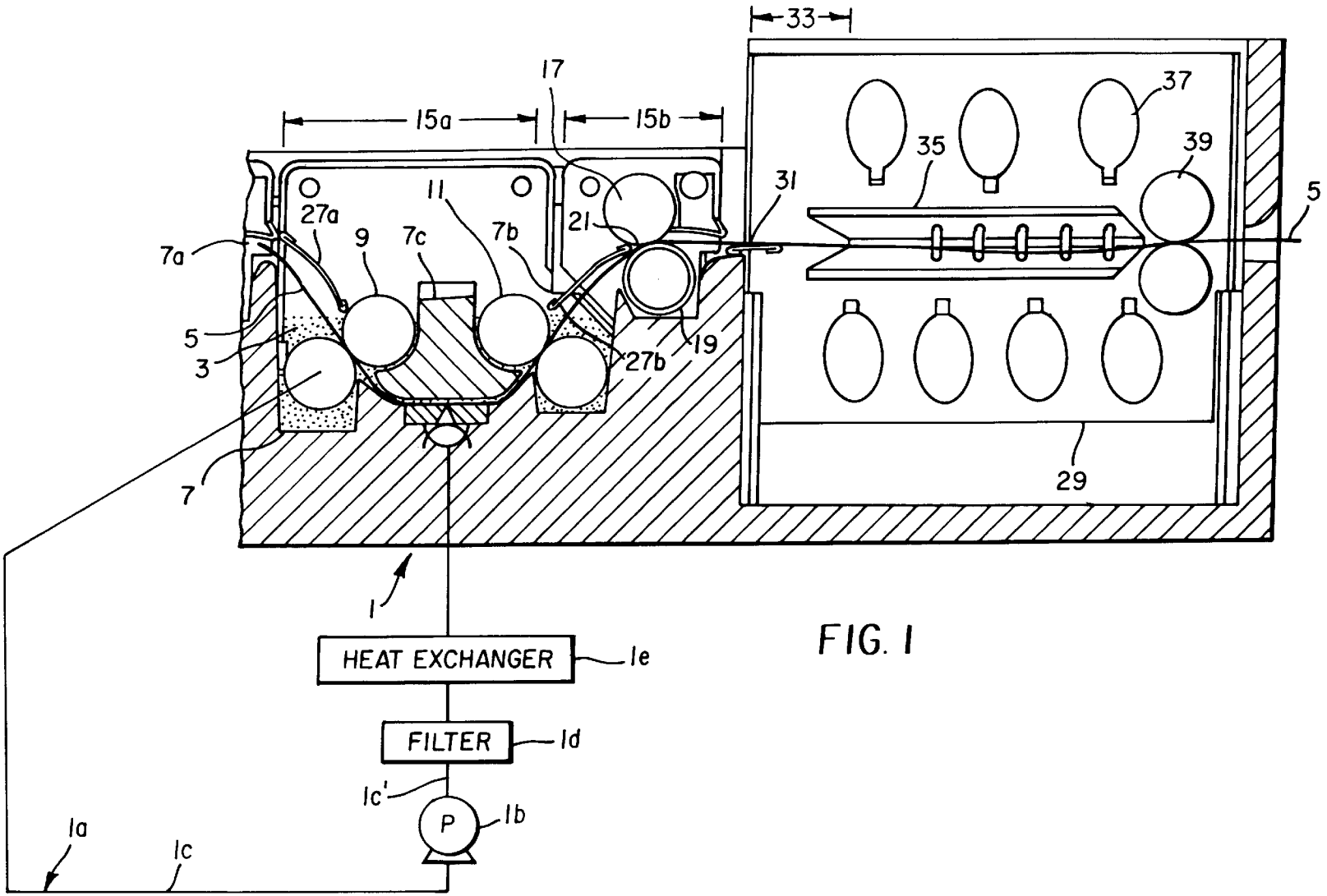
FIG. 1 is a schematic drawing of the apparatus of the present invention which applies a viscous solution to processed photosensitive materials prior to the drying of the materials.

Referring now to the drawings, wherein like reference numerals represent identical or corresponding parts throughout the several views, FIG. 1 illustrates an apparatus 1 for applying a layer of viscous solution 3 to processed photosensitive material 5 prior to the drying of the photosensitive material 5. The apparatus 1 can be added to an existing processing device as an accessory, or can be built-in as part of a new processor. It is further recognized that the apparatus can be a stand-alone apparatus.

The apparatus includes a tank 7 for holding the solution 3 to be applied. With respect to the viscous solution 3 which will form the protective coating on the photosensitive material 5, since the coating is to be applied in a minilab or photographic processing laboratory, water-based solutions that are substantially free of volatile organic compounds for the solution 3 are preferred for the disclosed embodiments. Preferred solutions can include combinations of one or more water-based latex solutions that can include at least one component which has a glass transition temperature $T_G$ (softening point) above 25° C. and at least one component which has a $T_G$ (softening point) at or below 25° C. These solutions can include acrylic or acylate polymers, vinyl polymers, polyurethanes, polyesters and the like. Additional components may including surfactants, spreading agents, lubricants, anti-blocking agents, curing agents, etc. The solution 3 can have a specific viscosity, for example, ranging from 1–25 centipoise at a shear rate of around 2500 1/sec. It is recognized that numerous viscous solutions can be utilized and that the type of viscous solutions used is based on design considerations in view of the desired viscosity, water-proofing and scratch-proof properties of the applied coating.

The present specification describes the concept of applying a viscous solution to a photosensitive material. It is recognized that the viscous solution can initially be in the form of a solid, semi-solid or powder and thereafter converted to a viscous solution of a desired viscosity. There are a variety of ways for achieving the conversion of a solid, semi-solid or powder to a viscous solution of a desired viscosity. For example, a self-dispersing polymer could be used in a liquid concentrate, a solid tablet or powder form. In this case, tank 7 would start with a low-viscosity liquid (e.g. water) and the viscosity would build to a desired value dissolution or dispersion of a product via agitation. As a further example, two (or more) component systems could be added separately and mixed in-situ in tank 7. Either a chemical reaction or physical interactions between the components could result in the desired final viscosity of the solution. Agitation and/or temperature could be used to trigger this reaction or interaction. As a further example, a system in a low-viscosity state could be triggered to build viscosity via temperature, UV light or other radiation by undergoing polymerization or cross-linking reactions. Either of these will increase the molecular weight of the species in the solution to increase viscosity. As a still further example, thickening agents could be added to a lower-than-desired viscosity solution in order to arrive at the desired viscosity. These could be added as tablets or concentrates. A variation on this example would be the use of temperature-sensitive thickeners that would give you either too high or too low a viscosity at room temperature, but would deliver the desired viscosity at a certain tank/coating temperature. It could also be advantageous to consider shear-sensitive coating solutions. These are either too high or too low in viscosity under storage conditions, but change to a desired viscosity under shearing conditions seen under tank agitation conditions or coating flow conditions.

Basically, the above examples are solid-to-liquid or liquid-to-liquid transformations of a product, as delivered to tank 7, to the desired coating solution. As an even further example, it is possible to sparge a gas into the solution tank to induce a change. The triggers would include mixing, heat or radiation.

The above are representative examples indicating that the viscous solution can first be in the form of a solid tablet, powder, etc., and converted to the desired viscous solution to be used in the tank of the present invention. It is further recognized that other methods for the conversion of a coating product to a final viscous solution can be utilized within the context of the present invention.

Referring again to FIG. 1, the tank 7 includes transporting roller assemblies 9 and 11 for transporting the photosensitive material 5 from a tank entrance 7*a* to a tank exit 7*b*. The roller assemblies 9 and 11 are comprised of opposed rollers which are rotatably mounted within the tank 7 in the vicinity of a support 7*c* and can be drivingly connected to a drive mechanism.

The apparatus 1 should also include a recirculation means 1*a* for circulating the solution 3 through the tank 7 with the circulating means comprising a pump 1*b*, a conduit 1*c* connected to the pump 1*b* and the tank 7, and the transporting roller assemblies 9, 11 for transporting the photosensitive material 5. The apparatus of FIG. 1 can further include a filter module 1*d* connected to the pump 1*b* by means of a conduit 1*c*'. The filter module 1*d* can remove solid contaminates from the solution. A heat exchanger 1*e* can rapidly regulate the temperature of the solution 3 being applied. The disclosed embodiments of FIGS. 5–9 can also include a recirculation means as illustrated in FIG. 1 and described with reference to FIG. 1.

The combination of the tank 7 and roller assemblies 9 and 11 define a coating section 15*a* in which the solution is applied to both sides of the photosensitive material. The apparatus 1 further includes a control section 15*b* which can include the combination of a transport roller 17 and a metering roller 19 which are rotatably mounted on the apparatus 1. The control section 15*b* is utilized to control the thickness, uniformity and laydown amount of the solution 3 applied to the material 5 and therefore, provide for a protective coating having preferred and/or predetermined characteristics. In the embodiment of FIG. 1, the viscous solution 3 is applied to both sides of the material 5 by dipping the material 5 within the solution 3 held in the tank 7, and transporting the coated material 5 by way of the roller assemblies 9 and 11 to the control section 15*b*. The control section 15*b* includes a guide blade 27*b* which extends from the coating section 15*a* into the control section 15*b* and leads the coated material 5 to a nip portion 21 between the metering roller 19 and the transport roller 17 which applies an opposing force to the metering roller 19. At this point, the metering roller 19 provides for a control of the characteristics of the protective coating by controlling the thickness, uniformity and laydown amount of the applied viscous solution 3 on the material 5 to a specific layer thickness which is a preferred thickness.

Figure 2A:
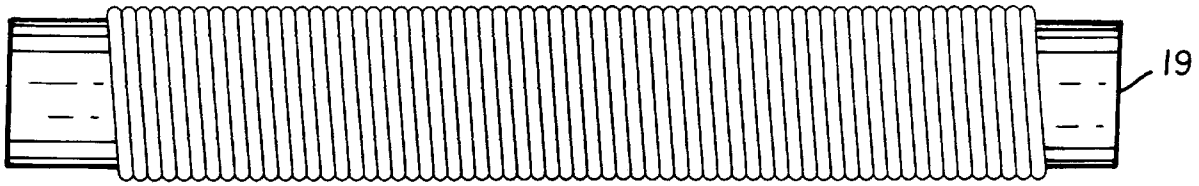
FIG. 2A illustrates a metering roller which can be utilized to control the thickness, uniformity and laydown amount of the applied viscous solution.
Figure 2B:
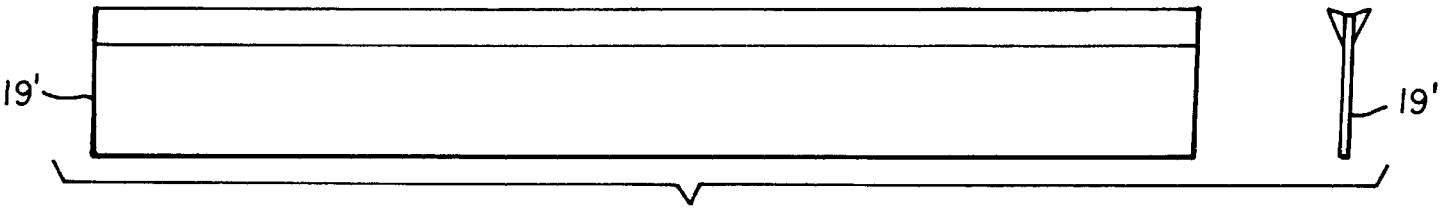
FIG. 2B shows a doctor blade as an alternative for controlling the uniformity, thickness and laydown amount of the applied viscous solution.
Figure 2C:
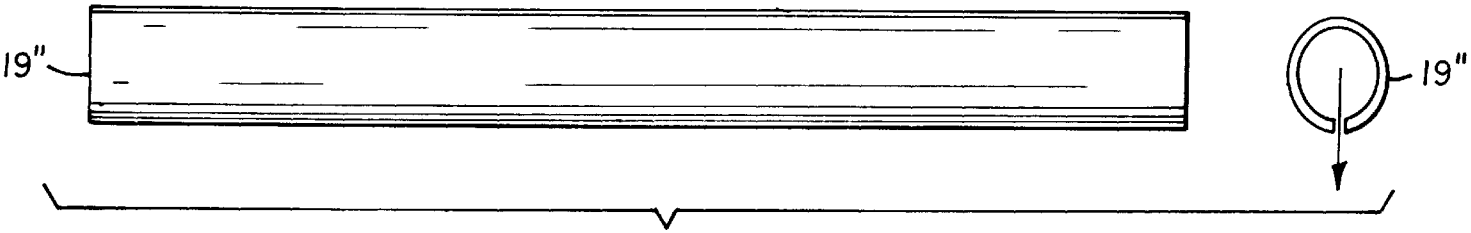
FIG. 2C shows an air knife as an alternative embodiment for controlling the uniformity, thickness and laydown amount of the applied viscous solution.
Figure 3A:
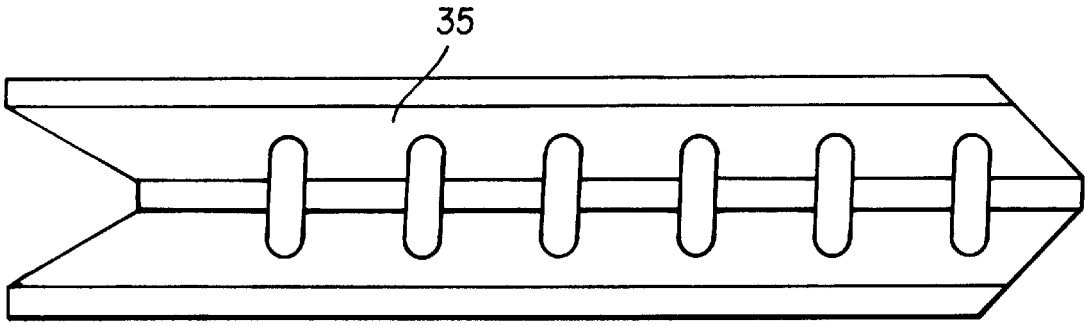
FIGS. 3A–3B illustrate features of the paper sheet guide of the dryer.
Figure 3B:
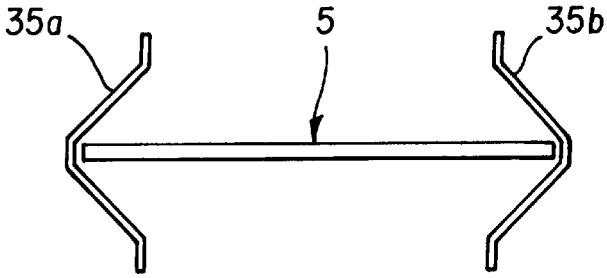

FIGS. 2A–2C illustrate examples of devices for metering and thereby controlling the thickness, uniformity and laydown amount of the applied viscous solution 3 on the photosensitive material 5 which can be utilized in the disclosed embodiments. FIG. 2A illustrates in detail the metering roller 19 which can be, for example, a wire wrapped roller bar that can be set across the material 5 and applied against the solution 3 coated on the material 5, to remove a desired amount of the solution 3 in a controlled manner, and leave a desired thickness of the solution 3 on the material 5. With respect to the characteristics of the protective coating, the desired range of dry coating thickness of the coating solution 3 on the material 5 is 0.3 to 6 micrometers. In terms of dry laydown which is expressed as mass per unit area, this corresponds to a range of 0.3 to 6 g/sq. meter. The percent solids in the coating solution is a factor in the thickness of the protective coating. The desired range of percent solids is from 1% to 50% (e.g. a 10% solids solution can have 10 parts film forming polymer and 90 parts water which evaporates upon drying). Therefore, the highest wet laydown corresponds to the thickest dry coating made from the most dilute solution, and the lowest wet laydown corresponds to the thinnest dry protective coating from the most concentrated solution. From this the range of wet laydown is 0.6 to 600 cc/sq meter (wet laydown being commonly expressed in units of volume per unit area).

Accordingly, the preferred range of dry thickness is 0.3 to 6 micrometers, the preferred range of dry laydown is 0.3 to 6 g/sq meter, and the preferred range of wet laydown is 0.6 to 600 cc/sq meter.

FIG. 2B is an alternate way of controlling the thickness, uniformity and laydown amount of the solution 3 as described above, and illustrates a doctor blade 19' which can be controlled to come into contact with the material 5 with the solution 3 coated thereon to remove a desired amount of solution therefrom. FIG. 2C illustrates an air knife 19" which can be used to blow air onto the solution 3 on the material 5. The air pressure distribution across the material 5 can be adjusted to control the thickness, uniformity and laydown amount of the applied viscous solution on the photosensitive material.

Therefore, during use, as the material 5 leaves an existing processor, it is guided by a guide blade 27*a* toward the roller assemblies 9 and 11 which guide the material 5 as it is dipped and coated with a layer of the solution 3. In the embodiment of FIG. 1, the photographic material 5 is dipped into the solution 3 which is applied to both sides (coating section 15*a*). As the photographic material 5 leaves the tank 7 at exit 7*b*, it enters the control section 15*b* having the metering roller 19 which controls the thickness, uniformity and laydown amount of the applied viscous solution on one side of the photosensitive material 5. Therefore, in the embodiment of FIG. 1, the entire photosensitive material or print is dipped and one side is controlled or metered as described with reference to FIGS. 2A–2C. It is recognized that the material to be coated could be a rolled web as illustrated, cut sheets or prints.

Since the present invention is concerned with applying a protective coating which prevents damage due to spills and protects against scratches, the metering and control feature of the present invention provides for a specific lay down control of the viscous solution 3 so as to provide for a specific layer thickness and a uniform coating.

FIG. 1 further illustrates a dryer 29 to which the coated material 5 is delivered after the coating section 15*b*. A guide 31 can be utilized to guide the material 5 into the dryer 29. Therefore, after the material 5 passes through the control section 15*b* in which the thickness, uniformity and laydown amount of the applied viscous solution 3 is controlled, the material 5 is delivered to the dryer 29 while the viscous solution is still wet and tacky. As illustrated in FIG. 1, the present invention provides for a spacing 33 between the control section 15*b* and a guide 35 positioned in the dryer 29. The guide 35 is connected in a known manner to air blowers 37 schematically illustrated in FIG. 1. The air blowers 37 deliver air for drying by way of, for example, tubes or hoses to the guide 35. Air from the air blowers 37 is directed onto the coated material 5 at the guide 35 so as to dry the coated material and provide for a protective coating on the material. The spacing 33 between the exit of the control section 15*b* and the entrance to the guide 35 is such that it permits the material 5 with the solution applied thereon to be transported through part of the dryer 29 without the surface of the coated material 5 being disturbed or touched while drying is occurring. The illustrated guide 35 or other known mechanisms for transporting the photosensitive material by its edges can be utilized. After the material 5 has passed through the abovementioned spacing 33, the material 5 is slowly transported between the guide 35 and the air-blowers 37 of the dryer 29 and transported out of the dryer 29 by way of transport roller assembly 39. Preferred drying ranges within the dryer are normal temperature ranges needed for drying photosensitive material. For example, a preferred drying range can be within, but not limited to, 85° F. to 200° F.

Referring now to FIGS. 3A–3B and 4A–4C which illustrate the specifics of the guide 35, the guide 35 can include edge guide members 35*a*, 35*b* which serve to guide the material or sheet 5 through the dryer 29.

Figure 4A:
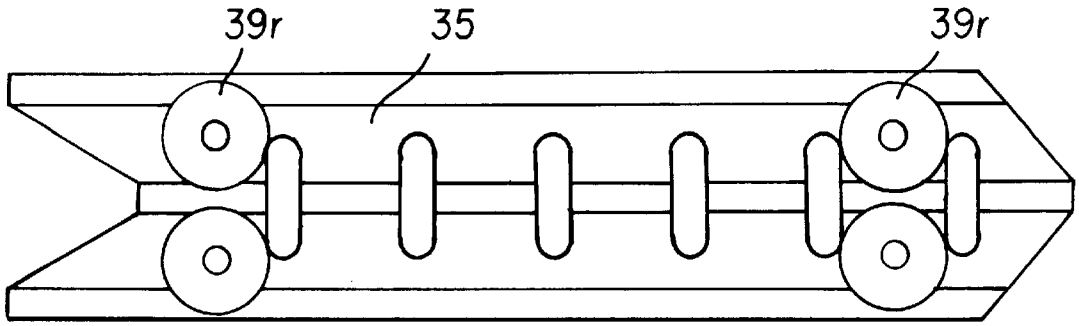
FIGS. 4A–4C illustrate features of the paper sheet edge guide and edge drive of the dryer.
Figure 4B:
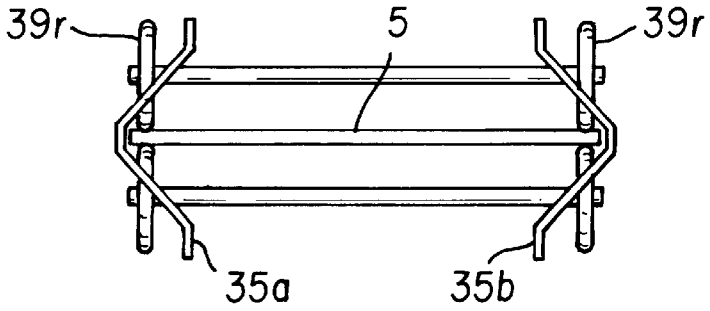
Figure 4C:
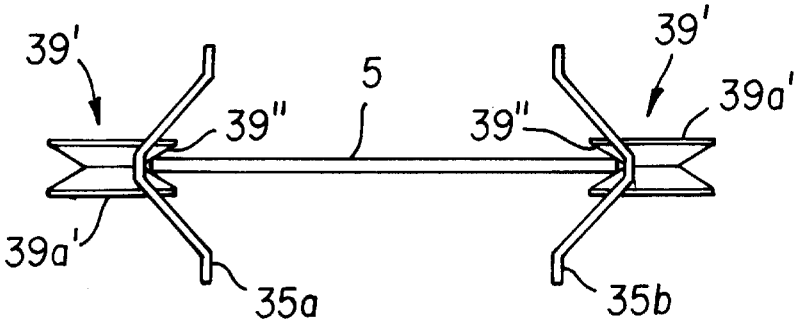

In an alternative embodiment, the guide 35 can include drive rollers 39*r* (FIGS. 4A, 4B) which contact the edge surfaces of the material and work in combination with the edge guide members 35*a*, 35*b* to facilitate the transporting of the material or sheet 5 through the dryer 29 and to the roller assembly 39 so as to exit the dryer 29. As an alternative arrangement, as shown in FIG. 4C, a roller and guide assembly 39' can be used. The roller and guide assembly 39' has a roller 39*a*' with a V-shaped opening 39" which contacts the edges of the material 5, and works in combination with guide members 39'" to guide material 5 through the dryer.

Referring now to FIG. 5, this figure illustrates an alternate embodiment of the apparatus of the present invention. As illustrated in FIG. 5, the apparatus 100 can comprise a tank 40 that includes the viscous solution 3. Rotatably mounted within the tank 40 is a roller assembly 41 and a guide blade 47. The guide blade 47 leads the material 5 to a pivotable or rotatable guide 49 which is pivotable to various angles to thereby control the angle by which the material 5 leaves the solution 3. By controlling the angle by which the material 5 leaves the solution 3, the amount of solution 3 remaining on the material 5 can be controlled.

Therefore, during use of the embodiment of FIG. 5, the material 5 is fed in the arrow direction 51 from an existing processing assembly into the tank 40 having the viscous solution 3 therein. The material 5 is completely immersed in the viscous solution 3 as illustrated in FIG. 5 and then guided by way of the combination of the guide blade 47 and the pivotable guide 49. The amount of solution and thereby the thickness of the solution left on the material 5 is controlled by the pivotable guide 49. That is, in this embodiment the angle by which the material 5 leaves the solution is controlled by pivoting the guide 49. This thereby controls how much solution 3 is left on the material 5 as the material 5 leaves the solution 3 which permits a control over the thickness of the solution. the material thereafter exits the tank 40 at exit 53 and enters a dryer 55 which can be similar to the dryer described with reference to FIG. 1.

In the embodiment of FIG. 6, the photosensitive material 5 is transported from a processor to the apparatus 200 which comprises a tank 60 that includes a rotatably mounted transport roller assembly 63. The roller assembly 63 delivers the photosensitive material 5 to a coating roller 65 which is partially immersed in the viscous solution 3. The coating roller 65 coats one side of the photosensitive material 5 which is then transported to a metering roller 67. The metering roller 67 meters or controls the one side of the material 5, as discussed with reference to FIG. 1, to control and make uniform the thickness of the applied viscous solution 3. In this embodiment, instead of utilizing a transport roller opposing the metering roller 67 as shown in FIG. 1, the transport roller assembly 63 and the first set of rollers 39 of the dryer 69, with respect to the transport direction of the material 5, act as tensioning rollers. The tensioning rollers tension the material 5 and apply a force on the material 5 that opposes the force of the metering roller 67. As an alternative, dedicated tensioning rollers could be placed at selected positions along the conveying path of the material 5.

After the material 5 leaves the tank 60 it exits through 60*a* and is delivered to a dryer 69 which dries the coated material as previously discussed, and includes a guide 35 and rollers 39, 39' or 39*r* as discussed above and illustrated in FIGS. 4A–4C.

Figure 7:
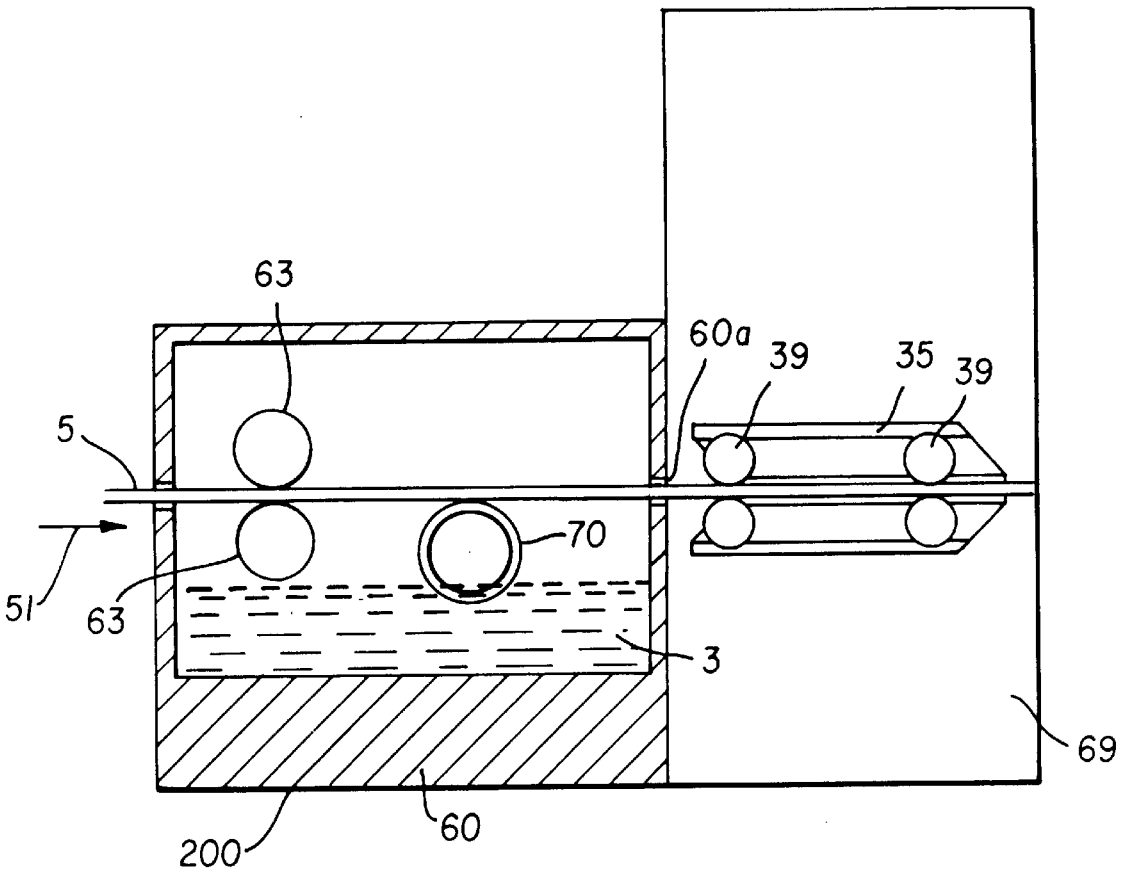
FIG. 7 is a variation of the apparatus of FIG. 6.

The embodiment of FIG. 7 is similar to the embodiment of FIG. 6 except that instead of utilizing a combination of a coating roller 65 and a metering roller 67 as illustrated in FIG. 6, the embodiment of FIG. 7 utilizes a combined single coating and metering roller 70. Therefore, as illustrated in FIG. 7, the combined coating and metering roller 70 is partially immersed in the viscous solution 3 such that when the material 5 is delivered by the roller assembly 63, the coating and metering roller 70 coats one side of the material 5 and at the same time it meters the one side of the material 5. The coated material 5 thereafter exits the tank 60 through exit 60*a* and is delivered to the dryer 69 which functions as described with respect to FIGS. 1 and 6. The embodiment of FIG. 7 also utilizes tensioning rollers as described with reference to FIG. 6 to tension the material 5 and apply an opposing force to the force applied by the combined coating and metering roller 70.

Figure 8:
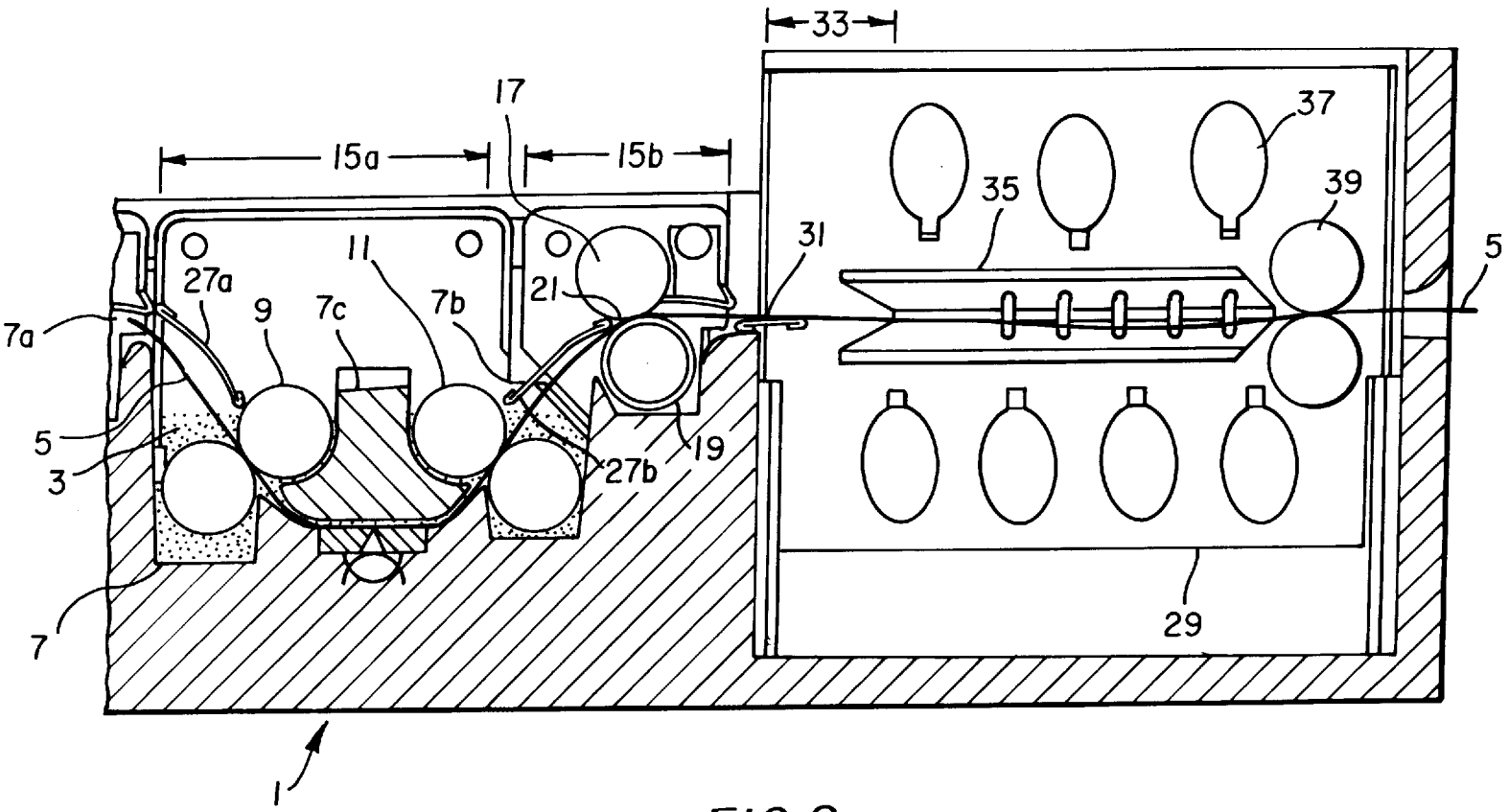
FIG. 8 is a schematic drawing similar to FIG. 1 showing an alternate embodiment with respect to controlling the thickness, uniformity and laydown amount of the viscous solution.

The embodiment of FIG. 8 is similar to the embodiment of FIG. 1 but instead of metering one side of the coated material 5, in the embodiment of FIG. 8, both sides of the coated material 5 are metered by way of metering rollers 19 in the manner described with reference to FIG. 1. The metering rollers 19 in FIG. 8 are located on opposing sides of the material 5 in the control section 15*b*. Therefore, in the embodiment of FIG. 8, both sides of the material 5 are coated in the coating section 15*a* by dipping, and both sides of the material 5 are metered by metering rollers 19 so as to control the thickness, uniformity and laydown amount of the viscous solution 3 applied thereon. The coated material 5 is then conveyed to the dryer 29 in the same manner as described in FIG. 1.

Figure 9:
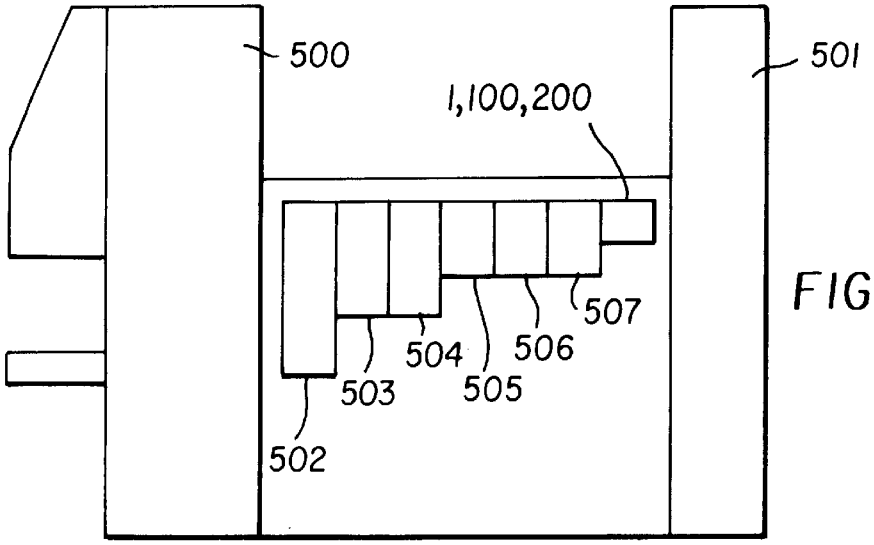
FIG. 9 is a schematic illustration showing the apparatus of the present invention built into an existing processor.

FIG. 9 illustrates an overview of a system to which the apparatus (1, 100, 200) of the present invention can be applied. As noted in FIG. 9, a processor in which an exposed photosensitive material can be subjected to at least one processing solution and any excess solution is thereafter removed, can include a printer 500, a dryer 501, and adjacent processing tanks 502–507. The printer 500 provides an image on the photosensitive material prior to processing. The processing tanks 502–507 represent steps in the developing process and can include developer solution, bleach solution, fixer solution and washing solution, or a combination of bleach-fix solution and a wash/stabilizer solution. The apparatus (1, 100, 200) of the present invention can be built into the end of the existing processing system as noted in FIG. 9 or built as part of a new processor. As an alternative embodiment, the apparatus (1, 100, 200) can be built into one of the existing wash tanks positioned at the end of the processor.

Figure 10A:
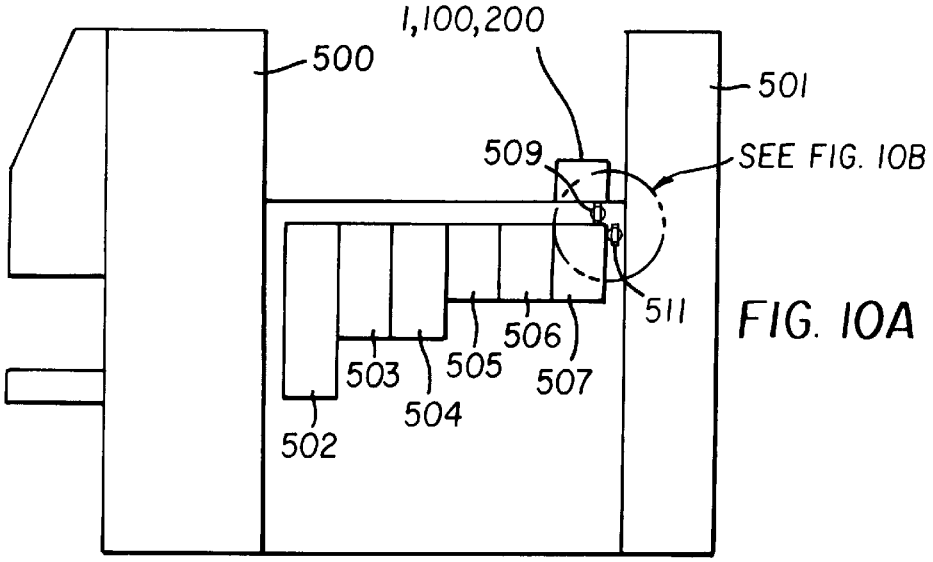
FIGS. 10A–10B, 11A–11B and 12 illustrate various options for placing the apparatus of the present invention.
Figure 10B:
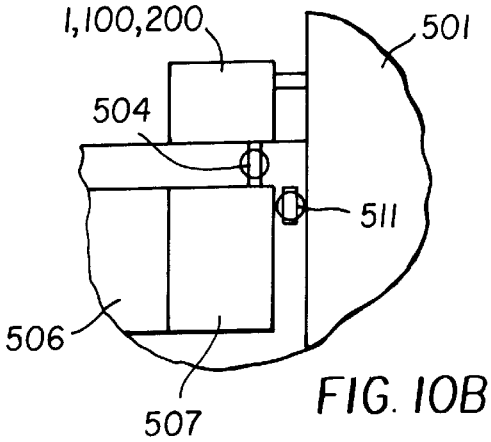

FIG. 10A illustrates an overview of a system in the same manner as FIG. 9 to which the apparatus (1, 100, 200) of the present invention can be applied. In FIG. 10A, movable bypass gates 509, 511 which are shown in detail in the view of FIG. 10B can be utilized to bypass the apparatus (1, 100, 200). Therefore, during use, after the material 5 passes through the last wash tank 507, it can be delivered directly to the apparatus (1, 100, 200) by way of the gate 509 as illustrated in FIGS. 10A and 10B, and thereafter delivered to the dryer 501. As a further feature, the gate 509 can be closed and the gate 511 can be opened so as to bypass the apparatus (1, 100, 200) and deliver the material 5 directly from the last wash tank 507 to the dryer 511.

Figure 11A:
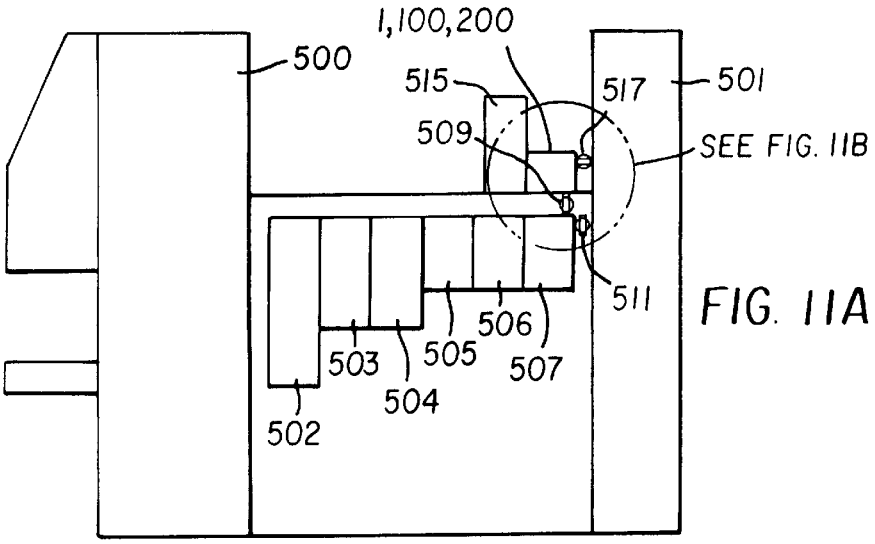
Figure 11B:
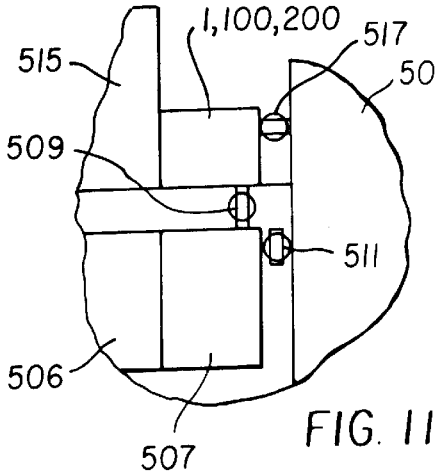

FIG. 11A is similar to FIG. 10A but includes an additional dryer 515. In addition to the movable by-pass gates 509 and 511 as discussed with reference to FIGS. 10A and 10B, the embodiment of FIG. 11A also includes an additional movable by-pass gate 517 as illustrated in the detailed view of FIG. 11B. Therefore, during the use of the embodiment of FIG. 11A, after the material passes from the last wash tank 507, it can be delivered to the apparatus (1, 100, 200) of the present invention by way of the gate 509. The material can thereafter be delivered to either the dryer 515 or 501. As a further route, the gate 509 can be closed and gate 511 opened so as to deliver the material from the last wash tank 507 to the dryer 501. If the gate 517 is open, the material can go from the first dryer 501 to the apparatus (1, 100, 200) and thereafter be delivered to a second dryer 515.

Figure 12:
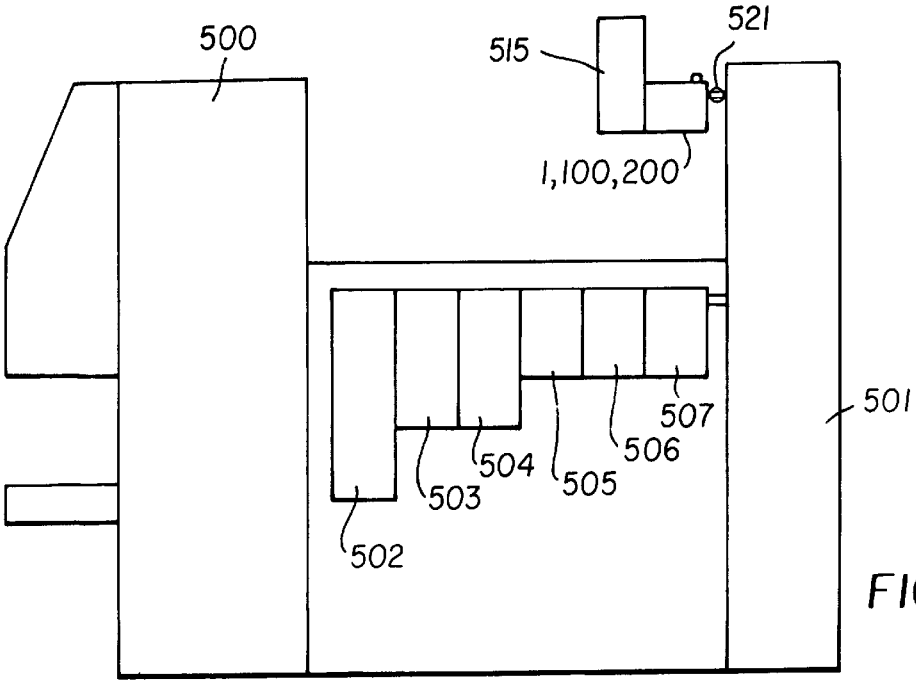

FIG. 12 illustrates an overview of a further embodiment of a system to which the apparatus (1, 100, 200) of the present invention can be applied. In the system of FIG. 12, after the material 5 passes from the last wash tank 507 and through the dryer 501, the material having a dry surface can be delivered to the apparatus (1, 100, 200) of the present invention by way of movable gate 521, and thereafter delivered to second dryer 515. As an alternative, a user can select to have the material 5 cut in the dryer 501. The single cut print can then be transported to the apparatus (1, 100, 200), and thereafter transported to the second dryer 515.

Figure 13:
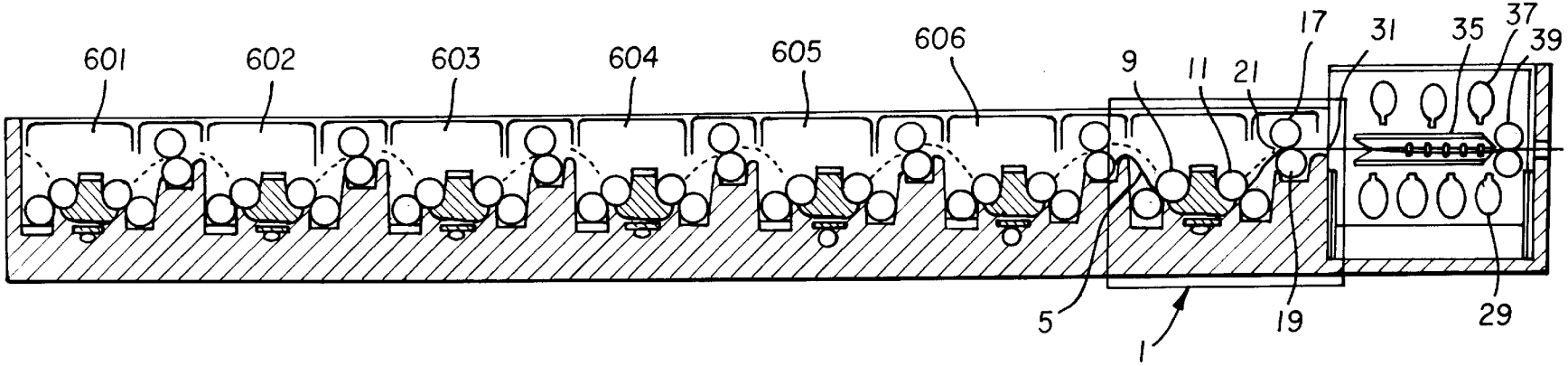
FIG. 13 is a schematic illustration of a processor showing the apparatus of the present invention added at the end.

FIG. 13 like FIG. 9 illustrates an example of the apparatus of the present invention as it is applied to an auto-tray processor such as disclosed in U.S. Pat. No. 5,400,106. Although FIG. 13 as an example shows the apparatus as illustrated in FIG. 1, it is recognized that any of the apparatus 100 or 200 can be applied to the processor of FIG. 13. As noted in FIG. 13, the auto-tray can include processing stations 601–606 which make up the specific points of the processing system, and can include developer solution, bleach solution, fixing solution, and washing solutions, or a combination of a bleach-fix solution and a wash/stabilizer solution in a known manner.

The apparatus (1, 100, 200) of the present invention for applying a protective viscous solution to a photosensitive material and thereafter controlling the solution can be added to the end of an existing processing system or built into the last wash tank, and the coated material can thereafter be transported to a dryer as previously described. Depending on design considerations, the photosensitive material can pass through the processor at speeds necessary for standard processing in wholesale labs, minilabs, maxilabs, etc.

Also, the photosensitive material in the form of a web or cut sheet can comprise film or final viewing media such as paper or resin coated paper, plastic papers such as polyethylene terephthalate, polyethylene naphthalate, Estar, Melinex, polyester and cellulose acetate or combinations of these materials, as described in co-pending U.S. application Ser. No. 08/862,708 filed May 23, 1997.

Figure 14:
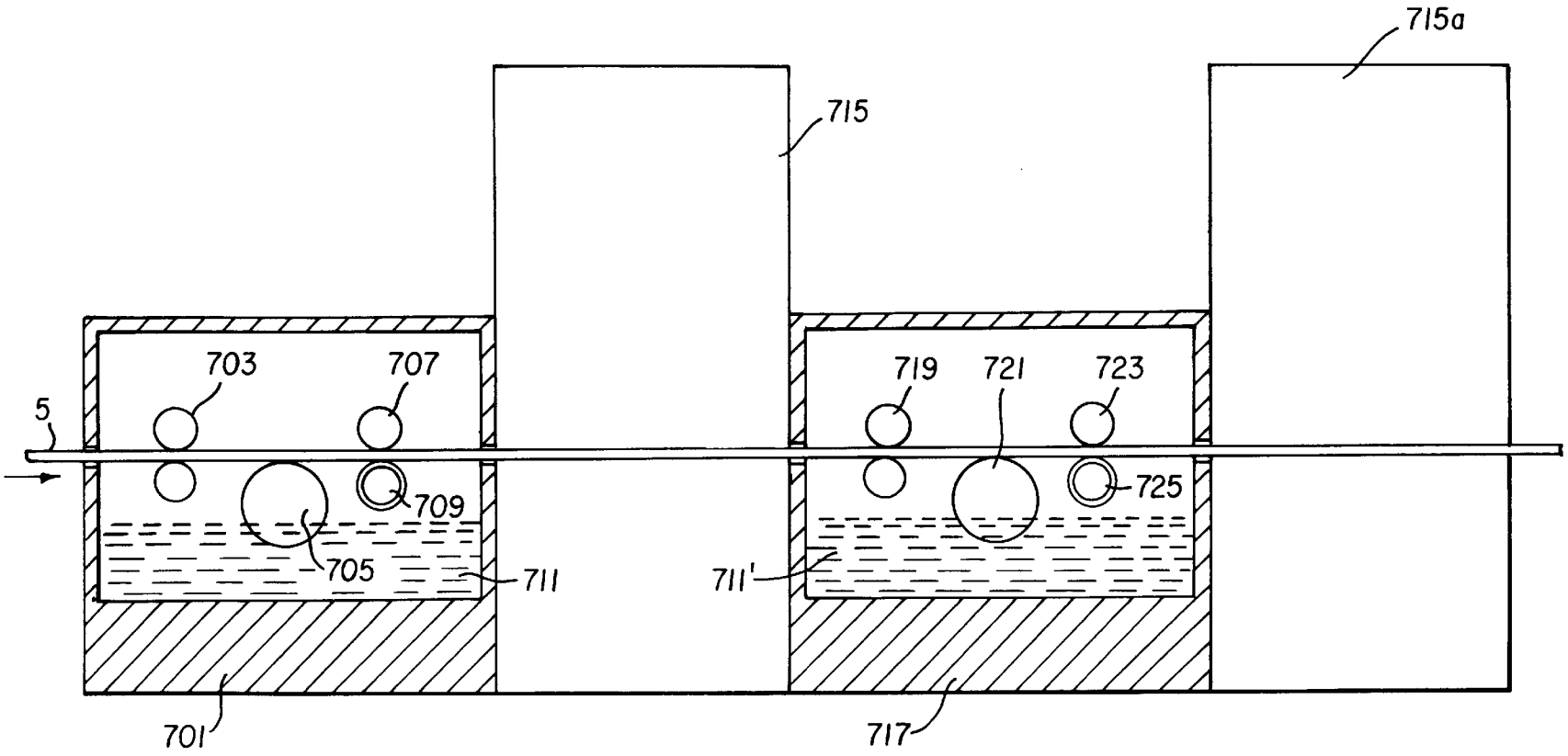
FIG. 14 is a schematic illustration of an embodiment of the system of the present invention.

FIG. 14 illustrates a modification of the system of the present invention. As illustrated in FIG. 14, the photosensitive material 5 can be delivered to a first tank 701 which includes a transport roller assembly 703 having opposing rollers rotatably mounted in the tank 701, and a coating roller 705 which is partially immersed in a viscous solution 711 held in the tank 701. The coating roller 705 is also rotatably mounted in the tank 701 and applies a layer of the viscous solution 711 to one side of the photosensitive material 5 which is thereafter transported between a transport roller 707 and an opposed metering roller 709. The metering roller 709 controls the thickness, uniformity and laydown amount of the applied viscous solution 711 in the manner previously described with reference to FIG. 1. The photosensitive material 5 with the applied viscous solution 711 is thereafter delivered to a dryer 715 which dries the coated photosensitive material. After the material 5 leaves the dryer 715, it is transported to a second tank 717 which includes a second viscous solution 711'. The second tank 717 further includes a second rotatably mounted transport roller assembly 719 and a second coating roller 721 which applies a further layer of viscous solution 711' onto the material 5. The material 5 is then transported between a second transport roller 723 and a second metering roller 725 which controls the thickness, uniformity and laydown amount of the applied viscous solution 711'. The photosensitive material 5 is thereafter delivered to a second dryer 715*a*. The second viscous solution 711' can be the same as the first viscous solution 711, or can be modified based on design considerations. The system of FIG. 14 as well as that of FIGS. 17–18 can be utilized when a double layer of coating protection is desired on one side of the material 5.

FIG. 14 only illustrates one example of applying and metering the viscous solution. As previously described, the photosensitive material 5 can be entirely dipped into the viscous solution and metered on one side; an application roller 705 as illustrated in FIG. 14 can be utilized to apply the viscous solution on one side of the material and metering can be performed on the same one side; or the entire print or material can be entirely dipped and thereafter metered on both sides.

Figure 15:
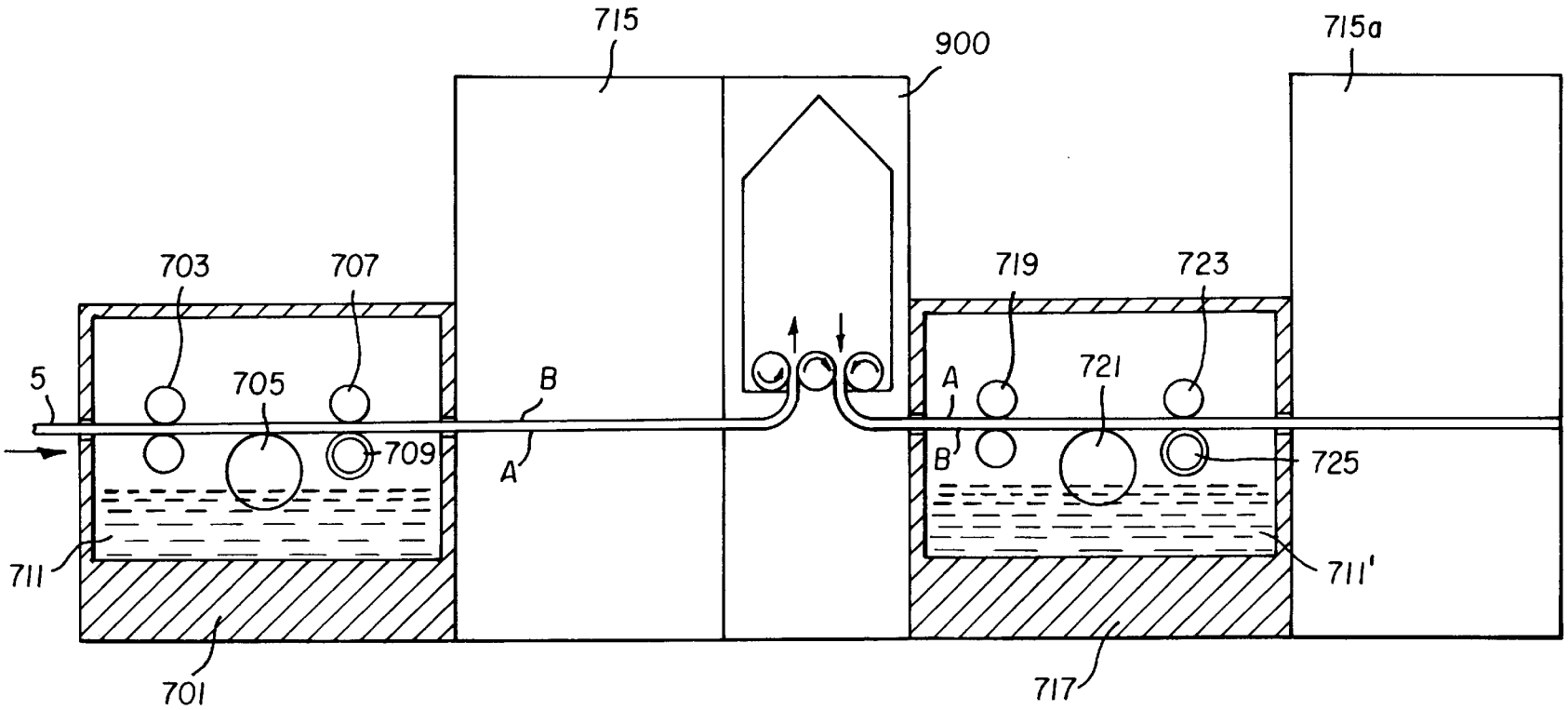
FIG. 15 is a schematic illustration of a further embodiment of the system of the present invention.

FIG. 15 illustrates a further variation of the system of the present invention. In FIG. 15, the elements which are the same as those illustrated in FIG. 14 are identified with the same reference numerals. FIG. 15 differs from FIG. 14 in that it includes a turn-over section 900 which flips or turns over the material 5 after it leaves the first dryer 715. Therefore, in FIG. 15, the first side A is coated and metered in the first tank 701. After the material 5 leaves the first dryer 715, the material 5 is turned over or flipped such that the second side B of the material 5 is coated and metered in the second tank 717. This provides for a protective coating on both sides of the material 5 which is controlled and metered in the manner discussed with reference to FIG. 1.

Figure 16:
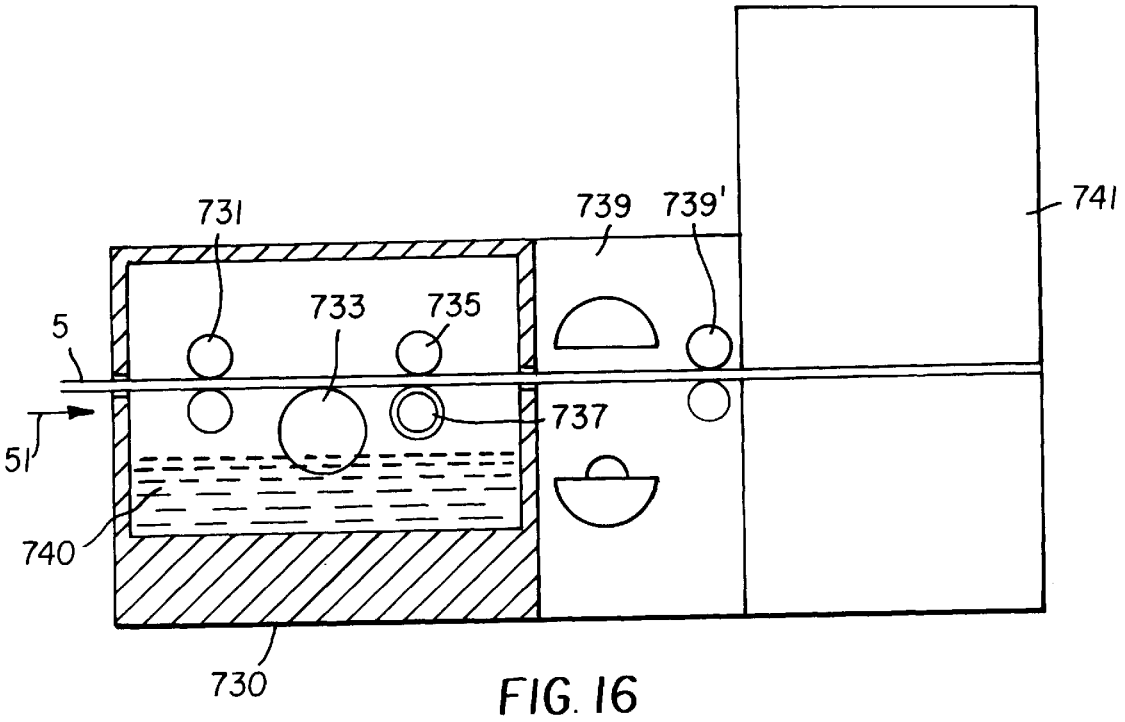
FIG. 16 is a schematic illustration of a further embodiment of the system of the present invention.
Figure 16A:
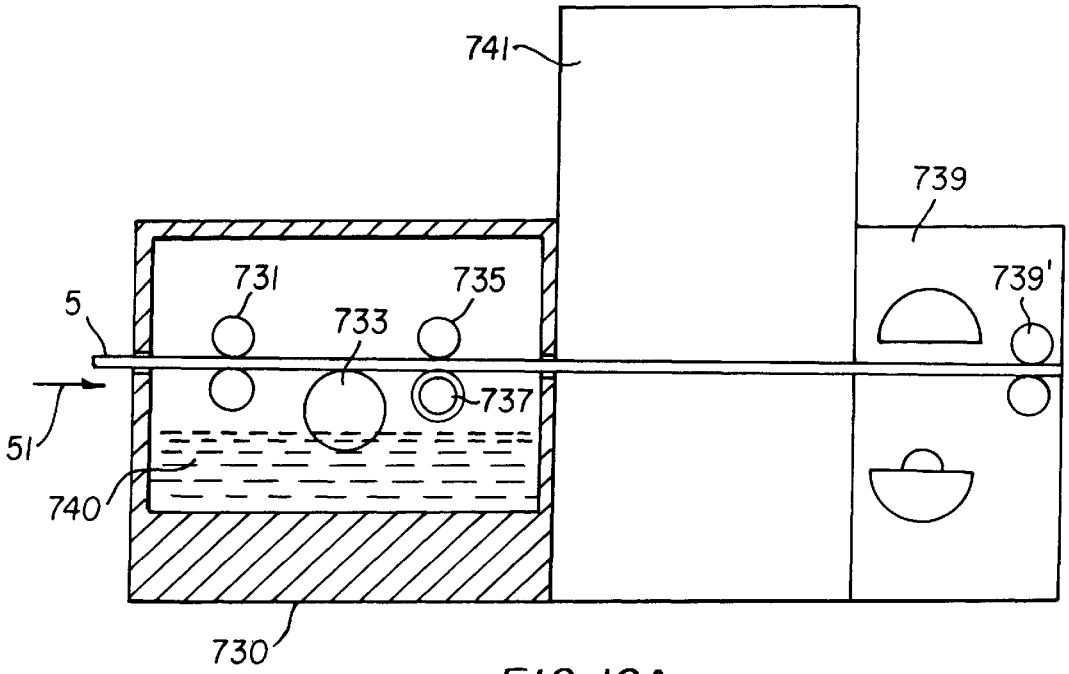
FIG. 16A is an alternative arrangement of FIG. 16.

FIG. 16 shows a further variation of the system of the present invention. In FIG. 16, the material 5 is delivered in the direction indicated by arrow 51 into a tank 730. A transport roller assembly 731 which includes opposing rollers is positioned in the tank 730 and delivers the material 5 to a coating roller 733. The coating roller 733 is partially dipped in a viscous solution 740. The coating roller 733 applies a layer of the viscous solution 740 onto the material 5, and the material is thereafter delivered to a metering roller 737 which is opposed to a transfer roller 735. The metering roller 737 controls the thickness, uniformity, and laydown amount of the applied viscous solution in a manner described with reference to FIG. 1, and thereafter the photosensitive material 5 is transported to a curing section 739. The coating on the photosensitive material 5 is cured at the curing section 739 without disturbing the applied layer. The curing can include an ultraviolet light treatment, an infrared heating, air drying or other known curing agents and methods. Curing agents can include those conventionally used in the coating industry to cross-link functional groups such as carboxylic acids, amines, alcohols, epoxy, vinyl, etc. Such cross-linking agents may be incorporated into the coating or may be introduced via a second application of a coating solution. After the coating on the photosensitive material is cured in the curing section 739, it is transported by roller assembly 739' to a dryer 741 in which drying is performed as previously described. The present invention is not limited to the arrangement in which drying occurs after curing. It is recognized that within the context of the present invention curing can occur after drying as shown in FIG. 16A. This concept also applies to the embodiments of FIGS. 17 and 18 which will now be described.

Figure 17:
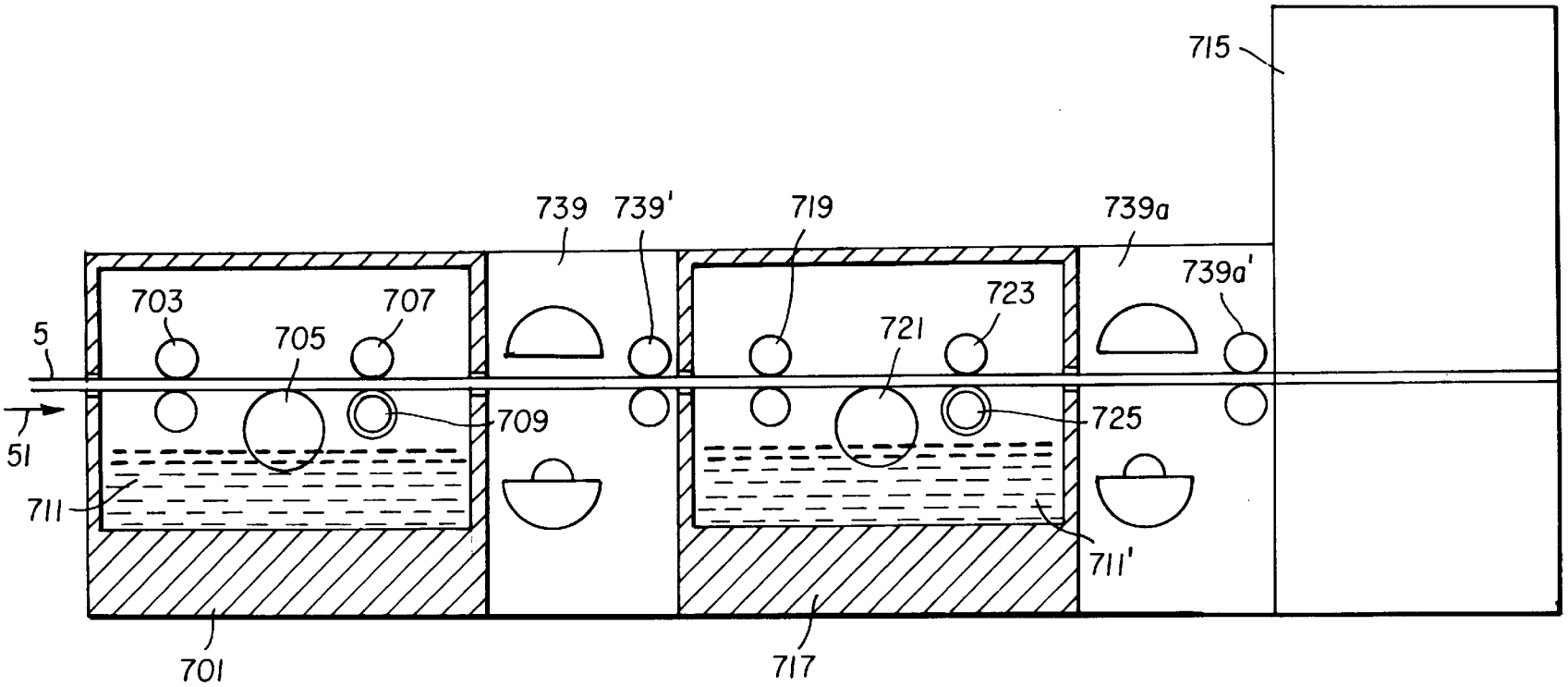
FIG. 17 is a schematic illustration of a further embodiment of the system of the present invention.

FIG. 17 is a further variation of the system of the present invention which includes multiple stations of coating, curing, coating, curing and drying. In FIG. 17, the material 5 is delivered from the last processing station in the direction of the arrow 51 to the first tank 701. The first tank 701 includes rotatably mounted transport assembly 703, coating roller 705, transport roller 707 and metering roller 709. The coating roller 705 is partially immersed in the viscous solution 711 so as to apply a layer of the viscous solution onto the surface of the photosensitive material and thereafter, the thickness, uniformity, and laydown amount of the applied viscous solution is controlled by the metering roller 709 in a manner previously described with reference to FIG. 1. The material 5 with the protective coating thereon is thereafter conveyed to curing section 739 as described in FIG. 16, and after curing, is delivered to second tank 717 in which a further layer of viscous solution 711' is applied by way of second coating roller 721. The second tank 717 includes second transport roller assembly 719 which delivers the photosensitive material to second coating roller 721. The material with the second viscous solution 711' applied thereon is thereafter delivered between second transport roller 723 and second metering roller 725 which controls the thickness, uniformity and laydown amount of the applied second viscous solution in a manner described with reference to FIG. 1. The photosensitive material is thereafter delivered to a second curing station 739*a* and after curing is delivered by rollers 739*a*' to dryer 715.

Figure 18:
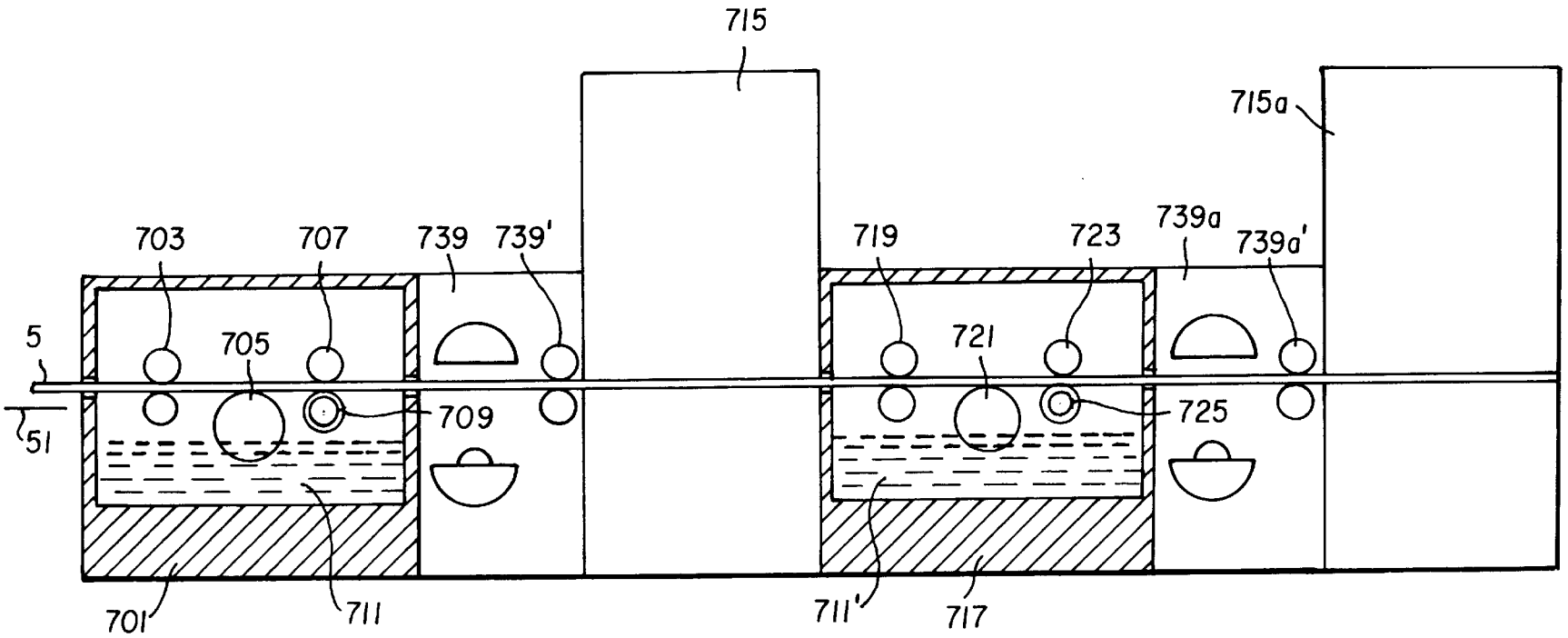
FIG. 18 is a schematic illustration of a further embodiment of the system of the present invention.

FIG. 18 shows a further variation of the system of the present invention which includes multiple stations for coating, curing, drying, coating, curing, and drying. In the embodiment of FIG. 18, the material 5 is delivered to first tank 701 which includes first viscous solution 711. Transport roller assembly 703 rotatably mounted in the first tank 701 delivers the photosensitive material 5 to first coating roller 705 which coats one side of the photosensitive material 5 with a layer of viscous solution 711. The photosensitive material 5 is thereafter delivered to transport roller 707 and opposing metering roller 709 which controls the thickness, uniformity, and laydown amount of the applied viscous solution in a manner described with reference to FIG. 1. The material 5 with the viscous solution coating is thereafter transported to curing section 739 as previously described and after the curing section 739 is delivered to first dryer 715. As further illustrated in FIG. 18, after the first dryer 715, the photosensitive material 5 is transported to second tank 717 having transport roller assembly 719 rotatably mounted therein. The transport roller assembly 719 transports the photosensitive material 5 to second coating roller 721 which is partially immersed in the second viscous solution 711'. The second coating roller 721 applies a layer of the second viscous solution 711' on the facing surface of the photosensitive material 5. The photosensitive material 5 is thereafter delivered to transport roller 723 and metering roller 725 which controls the thickness, uniformity, and laydown amount of the applied viscous solution in a manner described with reference to FIG. 1. The photosensitive material 5 with the protective coating that includes the first and second viscous solutions is thereafter delivered to second curing section 739*a* and second dryer 715*a* as illustrated in FIG. 11.

Figure 19:
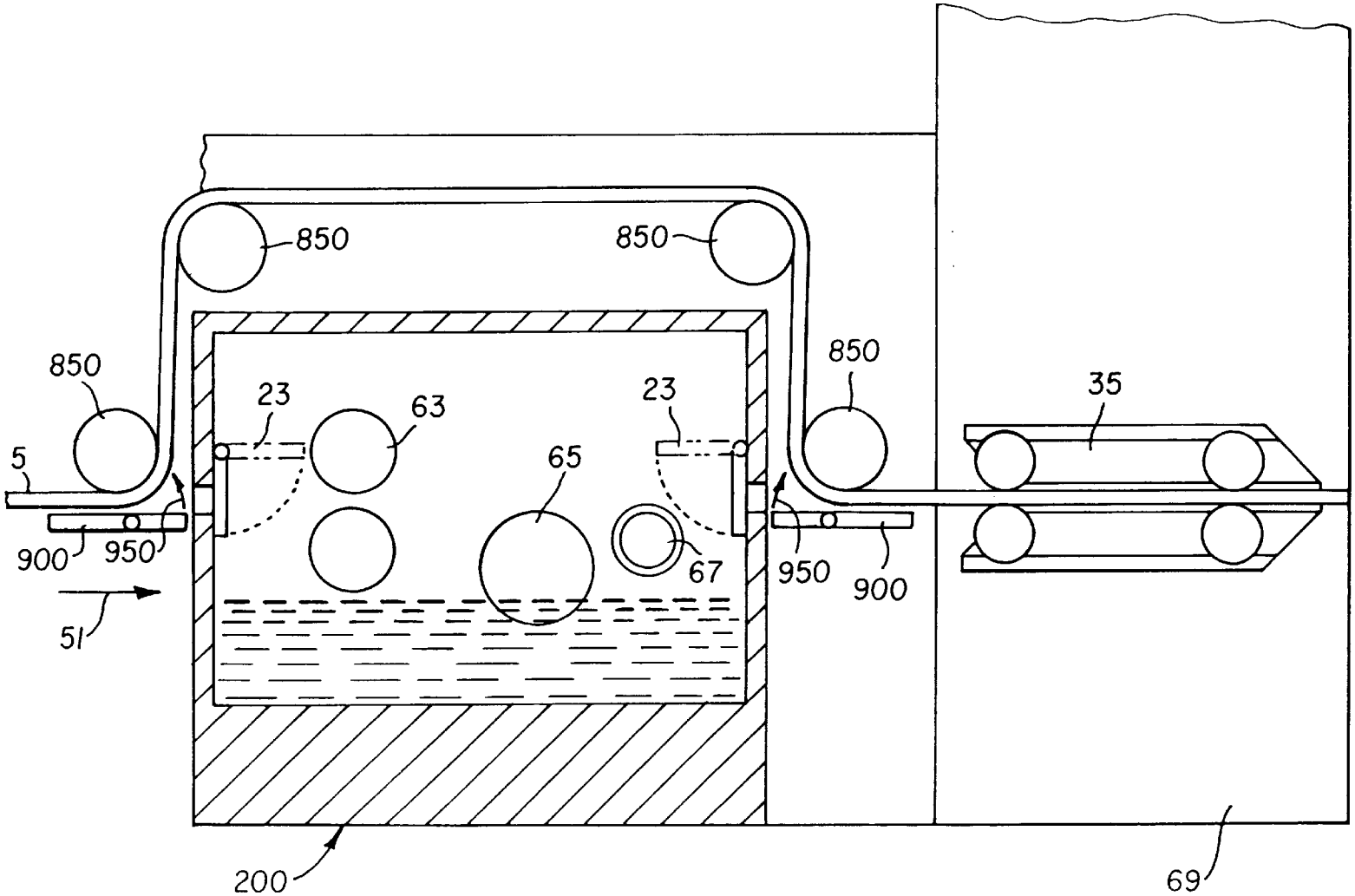
FIG. 19 shows a by-pass system of the apparatus of the present invention.

FIG. 19 illustrates a further variation of the system of the present invention in which a bypass is established for bypassing the apparatus of the present invention. In the embodiment of FIG. 19, the apparatus 200 as described with reference to FIG. 6 is shown. However, it is recognized that the bypass as illustrated in FIG. 19 can be applied to any of the apparatuses 1, 100 and 200 as described in the present specification. As illustrated in FIG. 19, the bypass can include rollers 850 which guide the material 5 around apparatus 200 and directly into the dryer 69. The apparatus further includes rotating guides 900 at the entrance and exit of the apparatus 200, as well as oxidation doors 23 which close the apparatus 200 when the material bypasses the apparatus so as to provide for a substantially closed chamber. It is recognized that the oxidation doors 23 can be spring-loaded doors which can be automatically and/or externally activated. In a by-pass mode, the oxidation doors 23 are closed and the guides 900 are rotated in the direction indicated by the arrows 950 to guide the material 5 in a by-pass path utilizing the rollers 850. In a non by-pass mode, the doors 23 are opened and the guides 900 are rotated to the position illustrated in FIG. 19 to lead the material 5 through the apparatus 200.

Therefore, the system of the present invention can include a curing section for curing the applied viscous solution and a drying section with a mechanism for transporting the coated material through either the curing or drying sections or both, in such a manner that the surface to which the viscous solution has been applied is not disturbed until the solution has dried sufficiently to prevent defects. The system of the present invention can also provide solutions of different viscosities to one or both surfaces of processed photosensitize materials prior to drying in a manner that allows the solution to be uniformly applied to the surface at specific layer thicknesses under conditions found in a photographic processor.

Figure 20:
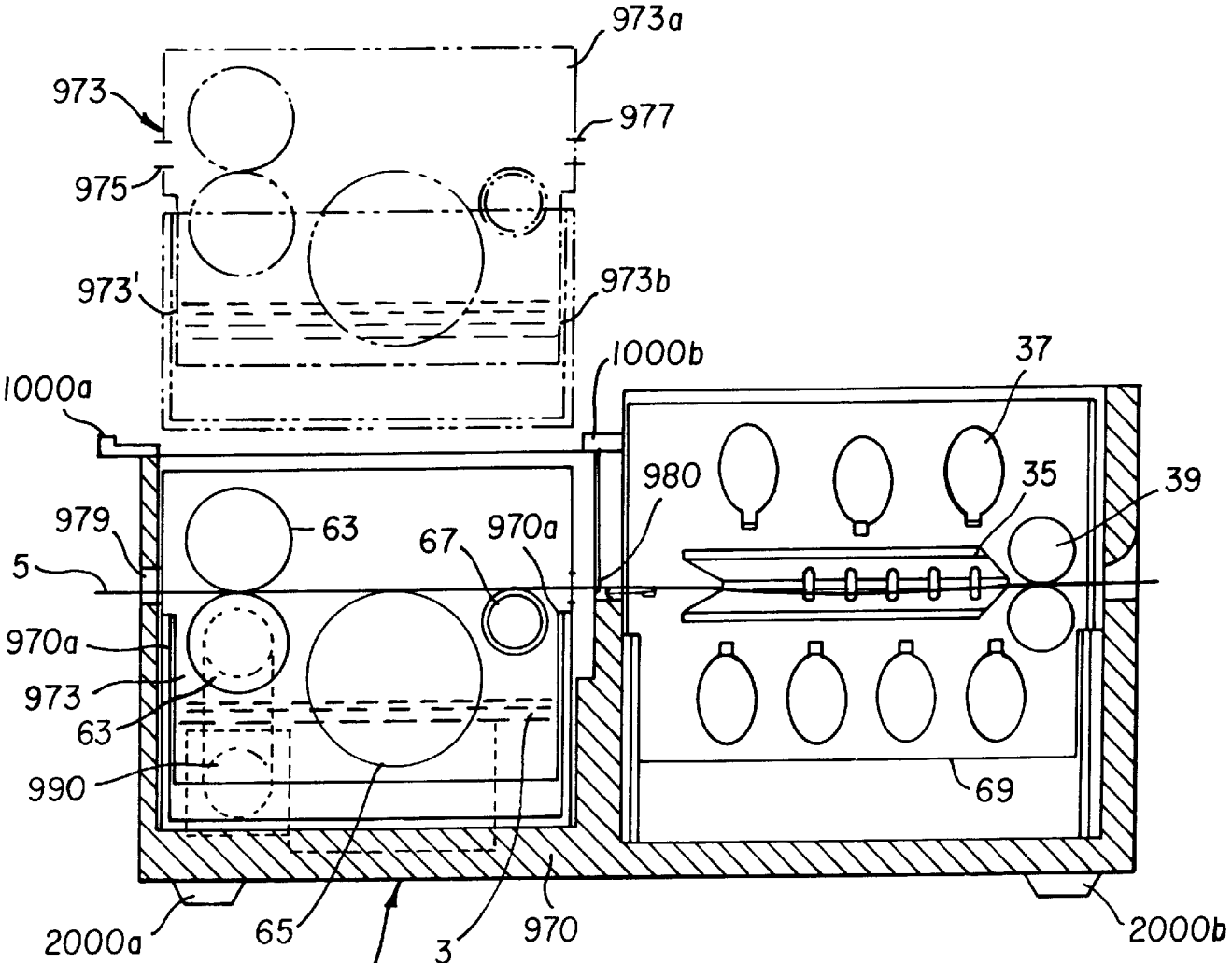
FIG. 20 is a further embodiment of the system of the present invention in which a removable coating module is illustrated.

FIG. 20 illustrates a further embodiment of the present invention. The embodiment of FIG. 20 is described with reference to the apparatus 200, however, it is recognized that the concept of the embodiment of FIG. 20 is also applicable to the apparatus 1 or 100, as well as all the different arrangements as previously described. In the embodiment of FIG. 20, the apparatus 200 comprises a removable coating module 973 and a body 970. The removable coating module 973 is slidably insertable into the body 970 and removable from the body 970 as illustrated in FIG. 20. The operation of the apparatus 200 of FIG. 20 is similar to the operation of the apparatus 200 as described with reference to FIG. 6.

A feature of the embodiment of FIG. 20 is that the coating module 973 which includes transport roller assembly 63, coating roller 65 and metering roller 67 can be slidably removed from the body 970 as illustrated by the dashed lines of FIG. 20. Therefore, at the end of a working cycle when the viscous solution is likely to solidify, the coating module 973 can be easily removed. This facilitates the maintenance of the coating module 973 which can be cleaned at the site, transported to a second location for cleaning or replaced with a further coating module 973. The coating module 973 can also be easily replaced when the viscous solution 3 contained therein is consumed. In the embodiment illustrated in FIG. 20, the coating module 973 can include the combination of a rack 973*a* inserted into a tray 973*b* which are removable either separately or as a unit, with the viscous solution 3 being contained in the tank 973*b* as shown. The provision of a removable rack 973*a* facilitates cleaning by making the components within the coating module 973 easily accessible.

In order to facilitate the removal of the coating module 973 from the body 970, the body 970 can include guides or projections 970*a* on opposing sides of the body 970. The guides or projections 970*a* cooperate with the other of guides or projections 973' on the coating module 973 so as to permit the slidable insertion and removal of the coating module 973 into and out of the body 970. The present invention is not limited to the illustrated guides and projections. For example, the bottom of the body can include a framed insert into which the coating module can be fitted and held or other known holding arrangements for securely keeping the coating module 973 within the body 970.

The coating module 973 further includes an inlet 975 and an outlet 977 for passage of material 5. Upon insertion of the coating module 973 into the body 970, the inlet 975 and the outlet 977 will be respectively aligned with an entrance 979 and an exit 980 of the body 970, so as to permit passage of the photosensitive material 5 therethrough. Also, with insertion of the coating module 973 into the body 970, the transport roller assembly 63 can be drivingly engaged with a drive mechanism 990 provided on the body 970. The drive mechanism 990 can include but is not limited to a motor and drive belt arrangement as illustrated in FIG. 20, which drives the transport roller assembly 63 so as to convey the photosensitive material 5 through the apparatus 200. For example, as an alternative, the drive mechanism 990 can be a drive gear arrangement. The rollers 65 and 67 can also be drivingly engaged with the drive mechanism 990 or a separate drive mechanism. As an alternative, one or both of the rollers 65,67 can be free-wheeling and rotated by way contact with the transported photosensitive material 5 passing therealong. After the insertion of the coating module 973 into the body 970, the coating module 973 can be selectively locked in place by way of locking mechanisms 1000*a,* 1000*b*.

Also, the apparatus 200 which includes the coating module 973 and body 970 can include a dryer 69 which operates in combination with the apparatus 200 as previously described. The combination of the apparatus 200 and dryer 69 as illustrated in FIG. 20 can be a stand-alone unit that can be selectively operatively connected to the end of an existing or new processor to provide a protective coating on processed photosensitive material.

Figure 21A:
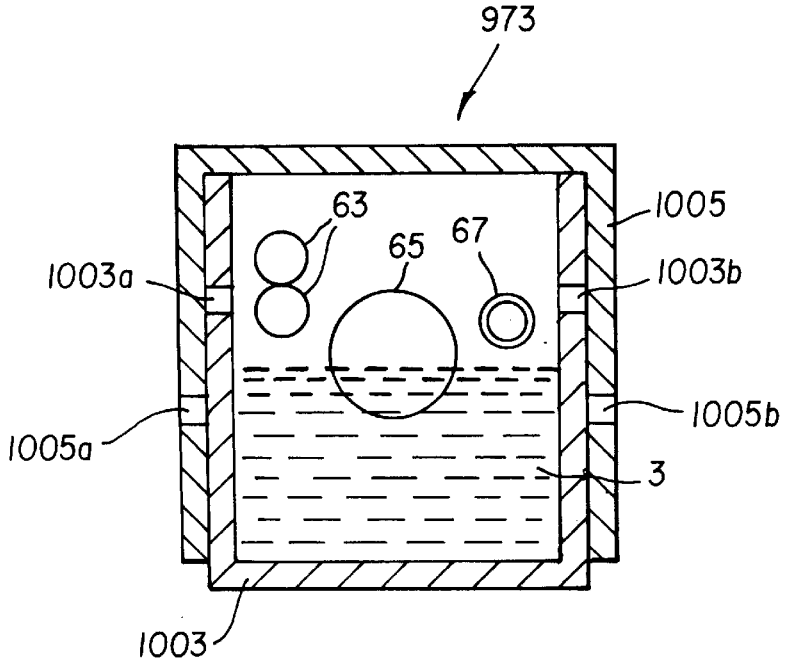
FIGS. 21A and 21B illustrate further variations of the removable coating module of the present invention.
Figure 21B:
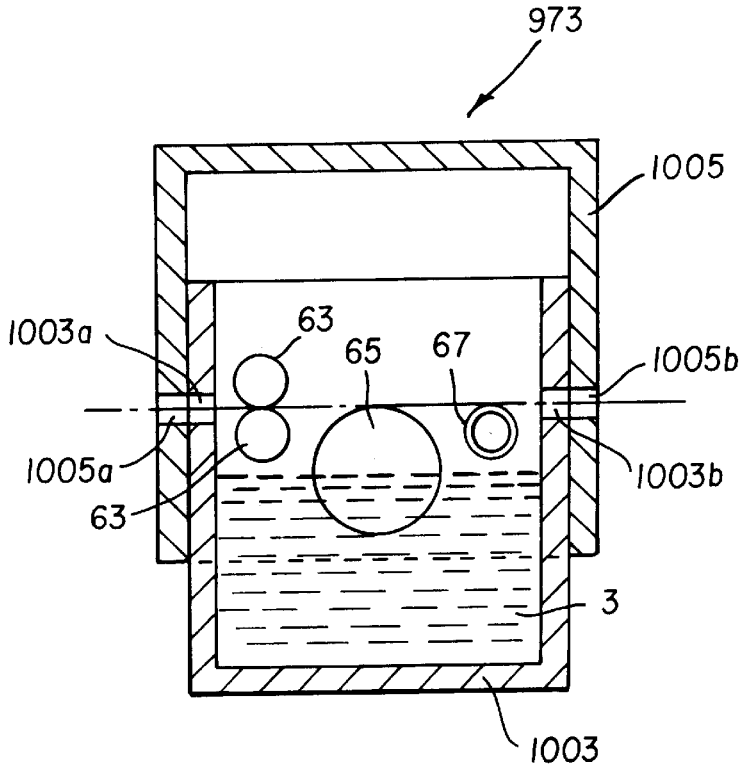

FIGS. 21A–21B illustrate an arrangement of the removable coating module 973 of the present invention. As shown in FIGS. 21A–21B, removable coating module 973 can include a first member 1003 having openings 1003*a* and 1003*b,* and a second member 1005 which can be slidably fitted over the first member 1003 to form a cover over the first member 1003. The second member 1005 has openings 1005*a* and 1005*b*. The removable coating module 973 can be similar to the apparatus 200 as illustrated in FIG. 6, however, it is recognized that the concept as illustrated in FIGS. 21A–21B is also applicable to the apparatus 1 or 100 and all the disclosed arrangements described in the present specification.

When the removable coating module 973 as illustrated in FIGS. 21A and 21B is inserted into the body 970 as illustrated in FIG. 20, the outer member 1005 will abut with the slot or projection 970*a* which will cause the outer member 1005 to slide upward as the inner member 1003 is placed at the bottom of the body 970. When the outer member 1005 is slid upward, the respective openings 1005*a* and 1003*a* and 1005*b* and 1003*b* are aligned as illustrated in FIG. 21B so as to permit the passage of photosensitive material to be coated therethrough.

When it is desired to remove the coating module 973 for cleaning or maintenance, the coating module 973 is lifted such that the outer member 1005 is slid to the position shown in FIG. 21A in which the respective openings 1003*a,* 1005*a,* and 1003*b,* 1005*b* are not aligned. This essentially seals off the removable coating module 973 so as to prohibit an inadvertent spillage of any solution remaining within the removable coating module. The outer member 1005 can also be separable from the inner member 1003 to facilitate the cleaning of the contents within inner member 1003.

As a further feature of the present invention, spring-loaded doors 23 as illustrated in FIG. 19 can be positioned at the inlet 975 and outlet 977 of the coating module 973. The spring-loaded doors 23 can be automatically and/or externally activated to open when the module 973 is inserted within the body 970. Also, the spring-loaded doors 23 can be closed when the module 973 is removed at the end of a working cycle to prevent an exposure of the contents within the module to air.

Furthermore, as illustrated in FIG. 1, the arrangement of the present invention can include a recirculation system. The insertion and/or removal of the coating module 973 into and/or from the body 970 will require a connection and/or disconnection of the appropriate fluid connections between the coating module 973, the processor and the recirculation system. In order to facilitate this insertion and/or removal, these fluid connections can include known closable valves and/or dripless valves such as disclosed in, for example, co-pending U.S. application Ser. No. 08/557,884 now U.S. Pat. No. 5,694,991, the subject matter of which is herein incorporated by reference. These dripless valves eliminate leakage during fluid transfer between mating systems.

The apparatus of the present invention as illustrated in FIGS. 20, 21A and 21B can be a stand-alone unit which can include stands 2000*a*,2000*b* and can be applied at the end of a processor so as to apply a protective coating on processed photosensitive material. By having the removable coating module 973, it is possible to remove the coating module 973 at the end of a working cycle to facilitate maintenance and cleaning and to avoid the solidification of the coating solution within the apparatus during a non-working cycle.

The invention has been described in detail with particular reference to certain preferred embodiments thereof, but it will be understood that variations and modifications can be effected within the spirit and scope of the invention.

What is claimed is:

1. A coating apparatus for use in a processor for processing photosensitive material which provides a protective coating on the photosensitive material, the coating apparatus comprising:

a body; and a removable coating module removably positioned within said body, said removable coating module having an inlet and an outlet through which the photosensitive material passes and being adapted to hold a solution of a predetermined viscosity therein;

said removable coating module comprising:

an applicator which applies a layer of the viscous solution on at least one surface of the photosensitive material as the photosensitive material passes through the removable coating module; and a controller which controls a thickness, uniformity and laydown amount of the viscous solution applied to the at least one surface of the photosensitive material.

2. A coating apparatus according to claim 1, wherein said removable coating module further comprises a transport assembly for transporting said photosensitive material through said removable coating module.

3. A coating apparatus according to claim 2, wherein said body comprises a drive mechanism which is drivingly engageable with said transport assembly when said removable coating module is inserted in said body.

4. A coating apparatus according to claim 1, wherein said controller comprises a metering roller which contacts the applied viscous solution on the at least one surface of the material.

5. A coating apparatus according to claim 1, wherein said controller comprises a doctor blade which contacts the applied viscous solution on the at least one surface of the material.

6. A coating apparatus according to claim 1, wherein the controller comprises an air knife which directs air to the applied viscous solution on the at least one surface of the material.

7. A coating apparatus according to claim 1, wherein said coating module is removably slidable within guides provided on said body.

8. A coating apparatus according to claim 1, wherein said body comprises an entrance and an exit which are respectively aligned with the inlet and outlet of said removable coating module when said removable coating module is inserted in said body.

9. A coating apparatus according to claim 1, further comprising a dryer positioned downstream of the body, with respect to a direction of travel of the material, which dries the viscous solution on the at least one surface of the material so as to provide for the protective coating on the at least one surface of the material.

10. A coating apparatus according to claim 1, wherein said coating module comprises a rack and tray arrangement.

11. A coating apparatus according to claim 1, wherein said controller controls the thickness, uniformity and laydown amount of the applied viscous solution so as to provide for a range of dry thickness of the protective coating of between 0.3 to 6 micrometers.

12. A coating apparatus according to claim 1, wherein said controller controls the thickness, uniformity and laydown amount of the applied viscous solution so as to provide for a dry laydown amount of the protective coating within a range of 0.3 to 6 g/sq meter.

13. A coating apparatus according to claim 1, wherein said controller controls the thickness, uniformity and laydown amount of the applied viscous solution so as to provide for a wet laydown amount of the viscous solution within a range of 0.6 to 600 cc/sq meter.

14. A coating apparatus according to claim 1, further comprising a locking mechanism for locking said coating module within said body.

15. A coating apparatus according to claim 1, wherein said coating module comprises a first member with first and second openings and a second member slidable on the first member to form a cover on said first member, said second member having third and fourth openings, such that when said coating module is positioned within said body, said first and second members slide with respect to each other from a first position in which said first and second openings of said first member are not aligned with said third and fourth openings of said second member to a position in which said first and second openings of said first member are respectively aligned with said third and fourth openings of said second member to form said inlet and said outlet of said coating module.

16. A coating apparatus according to claim 1, wherein said coating module comprises spring-loaded doors on the inlet and the outlet.

17. A coating apparatus according to claim 1, wherein said coating apparatus is a stand-alone unit.

18. A processor for developing a photosensitive material, the processor comprising:

a processing section for developing a photosensitive material, said processing section comprising at least one processing tank containing a processing solution therein; and a coating section disposed downstream of the processing section, with respect to a direction of travel of the material, said coating section comprising a body and a removable coating module removably positioned in said body, said removable coating module being adapted to hold a solution of a predetermined viscosity therein;

said removable coating module comprising:

an inlet and an outlet through which the material passes;

an applicator rotatably mounted in said coating module which applies a layer of the viscous solution to at least one surface of the material as the material passes through the coating module; and a controller which controls a thickness, uniformity and laydown amount of the viscous solution applied to the at least one surface of the material.

19. A processor according to claim 18, further comprising a dryer positioned downstream of the coating section, with respect to the travel direction of the material, which dries the coating solution on the at least one surface of the material to form a protective coating on the at least one surface of the material.

20. A processor according to claim 18, wherein said controller controls the thickness, uniformity and laydown amount of the applied viscous solution so as to provide for a range of dry thickness of the protective coating of between 0.3 to 6 micrometers.

21. A processor according to claim 18, wherein said controller controls the thickness, uniformity and laydown amount of the applied viscous solution so as to provide for a dry laydown amount of the protective coating within a range of 0.3 to 6 g/sq meter.

22. A processor according to claim 18, wherein said controller controls the thickness, uniformity and laydown amount of the applied viscous solution so as to provide for a wet laydown amount of the viscous solution within a range of 0.6 to 600 cc/sq meter.

23. A processor according to claim 18, wherein said controller comprises a metering roller which contacts the applied viscous solution on the at least one surface of the material.

24. A processor according to claim 18, wherein said controller comprises a doctor blade which contacts the applied viscous solution on the at least one surface of the material.

25. A processor according to claim 18, wherein said controller comprises an air knife which directs air to the applied viscous solution on the at least one surface of the material.

26. A processor according to claim 18, wherein said coating module is slidably insertable into guides located in said body.

27. A processor according to claim 18, wherein said coating module further comprises a transport assembly mounted therein for conveying the material through the coating module.

28. A processor according to claim 27, wherein said body comprises a drive mechanism which is drivingly engageable with said transport assembly when said coating module is inserted in said body.

29. A processor according to claim 18, wherein said body comprises an entrance and an exit which are respectively aligned with the inlet and outlet of the coating module when the coating module is inserted in said body.

30. A processor according to claim 18, wherein said coating module comprises a rack and tray arrangement.

31. A coating apparatus for use in a processor for developing photosensitive material which provides for a protective coating on the photosensitive material, the coating apparatus comprising:

a removable coating module removably positioned in a tank of a processor, said coating module having an inlet and an outlet through which a photosensitive material passes, said coating module being adapted to hold a solution of a predetermined viscosity therein, such that a photosensitive material which passes through said coating module is coated with said viscous solution; and a controller mounted in said coating module which control a thickness, uniformity and laydown amount of the applied viscous solution.

32. A coating apparatus according to claim 31, wherein said coating module comprises one of a projection and slot which is slidably insertable into the other of a projection and slot mounted in the tank.

33. A coating apparatus according to claim 31, wherein said inlet and said outlet of the coating module are respectively aligned with an entrance and an exit on the tank when the coating module is inserted in the tank, so as to permit a passage of the photosensitive material into the coating module.

34. A coating apparatus according to claim 31, further comprising a dryer positioned downstream of the coating module which receives the coated material, said dryer drying the coated material so as to provide for a protective coating thereon.

35. A coating apparatus according to claim 31, wherein said controller controls the thickness, uniformity and laydown amount of the applied viscous solution so as to provide for a range of dry thickness of the protective coating of between 0.3 to 6 micrometers.

36. A coating apparatus according to claim 31, wherein said controller controls the thickness, uniformity and laydown amount of the applied viscous solution so as to provide for a dry laydown amount of the protective coating within a range of 0.3 to 6 g/sq meter.

37. A coating apparatus according to claim 31, wherein said controller controls the thickness, uniformity and laydown amount of the applied viscous solution so as to provide for a wet laydown amount of the viscous solution within a range of 0.6 to 600 cc/sq meter.

38. A coating apparatus according to claim 31, further comprising a locking mechanism for locking said coating module within said tank.

39. A coating apparatus according to claim 31, wherein said coating module comprises a first member with first and second openings and a second member slidable on the first member to form a cover on said first member, said second member having third and fourth openings, such that when said coating module is positioned within said body, said first and second members slide with respect to each other from a first position in which said first and second openings of said first member are not aligned with said third and fourth openings of said second member to a position in which said first and second openings of said first member are respectively aligned with said third and fourth openings of said second member to form said inlet and said outlet of said coating module.

40. A coating apparatus according to claim 31, wherein said coating module comprises spring-loaded doors at the inlet and the outlet.

41. A coating apparatus for use in a processor for processing photosensitive material which provides a protective coating on the photosensitive material, the coating apparatus comprising:

a body; and a removable coating module removably positioned within said body, said removable coating module having an inlet and an outlet through which the photosensitive material passes and being adapted to hold a product therein which forms a protective coating on at least one surface of the photosensitive material;

said removable coating module comprising:

an applicator which applies the protective coating on the at least one surface of the photosensitive material as the photosensitive material passes through the removable coating module; and a controller which controls the application of the protective coating on the at least one surface of the photosensitive material so as to provide for a protective coating having a predetermined characteristic.

42. A coating apparatus according to claim 41, wherein said coating module comprises a first member with first and second openings and a second member slidable on the first member to form a cover on said first member, said second member having third and fourth openings, such that when said coating module is positioned within said body, said first and second members slide with respect to each other from a first position in which said first and second openings of said first member are not aligned with said third and fourth openings of said second member to a position in which said first and second openings of said first member are respectively aligned with said third and fourth openings of said second member to form said inlet and said outlet of said coating module.

* * * * *